US007575304B2

(12) United States Patent
Sugahara

(10) Patent No.: US 7,575,304 B2
(45) Date of Patent: Aug. 18, 2009

(54) LIQUID-DROPLET JETTING APPARATUS AND METHOD OF PRODUCING LIQUID-DROPLET JETTING APPARATUS

(75) Inventor: Hiroto Sugahara, Aichi-ken (JP)

(73) Assignee: Brother Kogyo Kabushiki Kaisha, Nagoyo-shi, Aichi-ken (JP)

( * ) Notice: Subject to any disclaimer, the term of this patent is extended or adjusted under 35 U.S.C. 154(b) by 514 days.

(21) Appl. No.: 11/434,936

(22) Filed: May 17, 2006

(65) Prior Publication Data

US 2006/0262162 A1 Nov. 23, 2006

(30) Foreign Application Priority Data

May 17, 2005 (JP) ..... 2005-143710

(51) Int. Cl.
*B41J 2/045* (2006.01)

(52) U.S. Cl. ..... 347/68

(58) Field of Classification Search ..... 347/68, 347/69–72

See application file for complete search history.

(56) References Cited

U.S. PATENT DOCUMENTS

2002/0005879 A1* 1/2002 Kitahara ..... 347/68
2003/0231230 A1* 12/2003 Shimamoto et al. ..... 347/68
2004/0130601 A1* 7/2004 Shimada ..... 347/68

FOREIGN PATENT DOCUMENTS

| | | |
|---|---|---|
| JP | H10 291316 | 11/1998 |
| JP | 2003 276204 | 9/2003 |
| JP | 2004 255702 | 9/2004 |

* cited by examiner

*Primary Examiner*—K. Feggins
(74) *Attorney, Agent, or Firm*—Baker Botts L.L.P.

(57) ABSTRACT

An ink-jet head, as a liquid-droplet jetting apparatus, includes a channel unit in which an ink channel is formed, a nozzle plate which has a nozzle which communicates with the ink channel, and a liquid repellent film which is formed on an ink jetting surface of the nozzle plate. A projection, which is inflated towards a side of the ink jetting surface more greatly than an area around the nozzle, is formed in a non-joining portion of the nozzle plate, at which the nozzle plate is not joined to the channel unit. Accordingly, there is provided a liquid-droplet jetting apparatus which is capable of preventing damage of the liquid repellent film around the nozzle, and a method of producing the liquid-droplet jetting apparatus with which it is possible to easily form a structure for preventing the damage of the liquid repellent film around the nozzle.

17 Claims, 16 Drawing Sheets

LIQUID-DROPLET JETTING APPARATUS AND METHOD OF PRODUCING LIQUID-DROPLET JETTING APPARATUS

BACKGROUND OF THE INVENTION

1. Field of the Invention

The present invention relates to a liquid-droplet jetting apparatus which jets liquid droplets, and a method of producing the liquid-droplet jetting apparatus.

2. Description of the Related Art

In an ink-jet head which jets ink from nozzles onto a recording paper, when ink is adhered around an ejecting port of a nozzle when droplets of ink are jetted, there is a possibility that, due to the adhered ink, liquid droplets which are jetted subsequently fly in an incorrect direction (bending), and/or there is a variation in a volume of liquid droplets and a velocity of liquid droplets, thereby lowering the printing quality. In view of this, in a general ink-jet head, for preventing the ink from adhering to a portion in the vicinity of the ejecting port of the nozzle, a liquid repellent film (ink repellent film) which prevents the ink from adhering in the vicinity of the ejecting port of the nozzle is provided on a liquid-droplet jetting surface on which the ejecting port of the nozzle is arranged.

However, the recording paper as an objective onto which the liquid droplets are jetted is transported by leaving a very small gap (of about 1 mm, for example) from the liquid-droplet jetting surface. Therefore, there is a possibility that the liquid repellent film is damaged such that the liquid repellent film is exfoliated due to the contact of the recording paper or the like with the liquid-droplet jetting surface. In addition, while wiping the liquid-droplet jetting surface by a wiper to remove ink and/or dust adhered to the liquid-droplet jetting surface, there is a possibility that the liquid repellent film is damaged by friction with the wiper. Due to such factors, when the liquid repellent film around the ejecting port of the nozzle is damaged, the jetting direction of the liquid droplets is bent, and the printing quality is lowered.

In view of this, an ink-jet head which is capable of preventing the damage to the liquid repellent film formed in the vicinity of the ejecting port of the nozzle has been proposed. For example, in an ink-jet head described in Japanese Patent Application Laid-open No. 2004-255702, a portion of a nozzle plate around the ejecting port of the nozzle is pressed by an elastic body from a side of a surface of the nozzle plate, and a recess is formed in this portion. On the other hand, in an ink-jet head described in Japanese Patent Application Laid-open No. 2003-276204, the portion of the nozzle plate around the ejecting port of the nozzle is partially removed by a laser processing or an etching, and a recess is formed. Due to the recesses, the liquid repellent film formed in the vicinity of the nozzle hardly comes in contact with the wiper which is operated or activated during wiping, or with the recording paper which is transported closely to the liquid-droplet jetting surface, and the damage of the liquid repellent film is prevented.

SUMMARY OF THE INVENTION

As described above, in the ink-jet head of the Japanese Patent Application Laid-open No. 2004-255702, a recess is formed by pressing an elastic body from a side of the nozzle plate surface. However, in reality, a diameter of the nozzle is very small (about 20 μm, for example), and a gap between adjacent nozzles is very narrow. Therefore, it is necessary to form a recess with high accuracy around an ejecting port of each of the nozzles. However, in the method of pressing the elastic body around the ejecting port of each of the nozzles as described in Japanese Patent Application Laid-open No. 2004-255702, it is very difficult to form the recess with high accuracy.

Further, in an ink-jet head of the Japanese Patent Application Laid-open No. 2003-276204, a special processing is necessary for forming the recess with high accuracy, by partially removing the portion around the ejecting port of the nozzle of the nozzle plate by the laser processing or the etching, which in turn increases the production cost.

An object of the present invention is to provide a liquid-droplet jetting apparatus which is capable of preventing the damage of the liquid repellent film around an ejecting port of a nozzle, and a method of producing the liquid-droplet jetting apparatus with which a structure for preventing the damage can be formed easily.

According to a first aspect of the present invention, there is provided a liquid-droplet jetting apparatus including: a channel unit which includes a plurality of plates and in which a liquid channel is formed; and a nozzle plate which includes a nozzle communicating with the liquid channel, and a liquid repellent film formed on a liquid jetting surface in which an ejecting port of the nozzle is arranged, the nozzle plate having a joining portion which is joined to the channel unit and a non-joining portion which is not joined to the channel unit, a projection higher than an area around the nozzle being formed on the liquid jetting surface in the non-joining portion of the nozzle plate.

According to the first aspect of the present invention, in this liquid-droplet jetting apparatus, the nozzle plate is joined to the channel unit, for example, at the portion including the area around (in the vicinity of) the nozzle. On the other hand, the projection projecting toward the side opposite to the channel unit is formed in the non-joining portion of the nozzle plate. Therefore, by this projection, the liquid repellent film formed in the area around the nozzle is protected from a mechanical friction with the recording medium which is transported closely to the liquid jetting surface, and the wiper activated during the wiping operation, thereby preventing the damage of the liquid repellent film in the area around the nozzle. Further, the projection is formed by curving the non-joining portion, which is away from the area around the nozzle, in the direction opposite to the channel unit. Therefore, as compared to a conventional way of forming a recess by subjecting the area around the nozzle to a laser processing, the projection can be formed more easily since there is no need to perform any stringent precision control.

In the liquid-droplet jetting apparatus of the present invention, a surface of the projection may be formed to be a continuously smooth, curved surface. In this structure, as compared to a case in which the projection is formed as a shape having a level difference, it is easier to remove liquid droplets and/or dust adhered to the liquid jetting surface during wiping.

In the liquid-droplet jetting apparatus of the present invention, a space into which a fluid, for forming the projection by curving the non-joining portion toward a side opposite to the channel unit, is to be supplied may be formed between the non-joining portion of the nozzle plate and the channel unit. In this case, the space between the non-joining portion of the nozzle plate and the channel unit can be used as a space into which the fluid for forming the projection is supplied. Therefore, it is possible to form the projection by supplying the fluid into this space, and inflating the non-joining portion by the fluid, and thus the projection can be formed easily.

In the liquid-droplet jetting apparatus of the present invention, the space may form a part of the liquid channel. In this case, the part of the liquid channel can be used as the space into which the fluid for forming the projection is supplied. Therefore, there is no need to form this space separately from the liquid channel.

In the liquid-droplet jetting apparatus of the present invention, the space may be formed independently from the liquid channel, and the channel unit may have a communicating channel which communicates the space to an outside of the channel unit. In this case, the fluid can be supplied assuredly into the space formed between the channel unit and the non-joining portion of the nozzle plate, via the communicating channel.

In the liquid-droplet jetting apparatus of the present invention, the nozzle may be formed as a plurality of individual nozzles in the nozzle plate; the liquid channel may have a common liquid chamber which communicates with the individual nozzles; the plurality of plates may include a first plate and a second plate; a plurality of holes which form the liquid channel may be formed in each of the plurality of plates, and the plurality of plates may be joined mutually in a stacked form; the first plate formed with a space-forming hole which forms the space may be joined to the nozzle plate; and the space and the common liquid chamber may be partitioned by the second plate which is joined to a surface of the first plate on a side opposite to the nozzle plate. When a liquid droplet is jetted from an individual nozzle of the individual nozzles, pressure is applied to the liquid between the common liquid chamber and the individual nozzle by an actuator or the like. When the pressure is applied, a pressure fluctuation (change) is occurred in the common liquid chamber which communicates with the plurality of individual nozzles. When the pressure fluctuation is substantial, it has an adverse effect such that variation in volume of the liquid droplets and/or speed of the jetted liquid-droplets occurs in another jetting nozzle. However, in the present invention, since the common ink chamber and the space into which the fluid for forming the projection is supplied are partitioned by the second plate, it is possible to attenuate the pressure fluctuation in the common liquid chamber by the second plate.

In the liquid-droplet jetting apparatus of the present invention, the nozzle plate may be formed of a synthetic resin material. In this manner, when the nozzle plate is made of a synthetic resin material having a low rigidity or stiffness, it is easy to form the projection by deforming the non-joining portion.

In the liquid-droplet jetting apparatus of the present invention, a thickness of the nozzle plate may be partially decreased at the non-joining portion. In this case, since the stiffness of the non-joining portion is partially lowered, it is easy to form the projection by deforming the non-joining portion.

In the liquid-droplet jetting apparatus of the present invention, the projection may be arranged to surround an area in which the nozzle is formed. In this case, the damage of the liquid repellent film around the nozzle can be prevented assuredly.

In the liquid-droplet jetting apparatus of the present invention, the nozzle may be formed as a plurality of individual nozzles arranged in a row, in the nozzle plate; and the projection may be arranged parallel to a direction of the row of the individual nozzles. In this case, the liquid droplets can be jetted (discharged) simultaneously from the plurality of individual nozzles. In addition, by providing the projection parallel to the row of individual nozzles, when the liquid-droplet jetting apparatus of the present invention is used, for example, as a serial printer or a line printer in an ink-jet system, it is possible to assuredly prevent the recording medium from coming into contact with the liquid repellent film around the individual nozzles.

In the liquid-droplet jetting apparatus of the present invention, the channel unit and the nozzle plate may be structured to be movable integrally in a direction orthogonal to the direction of the row of the individual nozzles; and the projection may be arranged, in the nozzle plate, outside of an area in which the individual nozzles are formed, with respect to the direction orthogonal to the direction of the row. In this manner, when the liquid-droplet jetting apparatus is structured to be of a serial type which is movable in the direction (second direction: scanning direction) orthogonal to the direction of alignment (first direction) of the individual nozzles, the projection is formed in the outside of the area in which the individual nozzles are formed, with respect to the second direction which is the scanning direction. Accordingly, during the wiping, a wiper which moves in the scanning direction relative to the nozzle plate can be prevented from making a contact with the liquid repellent film around the individual nozzles.

In the liquid-droplet jetting apparatus of the present invention, a filling material may be filled between the non-joining portion of the nozzle plate and the channel unit. In this case, it is possible to suppress a deformation of the projection due to being pressed by the wiper during the wiping.

According to a second aspect of the present invention, there is provided a liquid-droplet jetting apparatus including: a channel unit in which a liquid channel is formed; and a nozzle plate including a nozzle communicating with the liquid channel, and a liquid repellent film formed on a liquid jetting surface in which an ejecting port of the nozzle is arranged;

wherein the nozzle plate is curved partially; and a projection which is higher than an area around the nozzle is formed in the liquid jetting surface.

According to the second aspect of the present invention, the nozzle plate is curved partially, and the projection which is higher or elevated than the area around the nozzle is formed on the liquid jetting surface. Accordingly, when an object having a plane (flat) shape comes near the nozzle, it is possible to prevent, by the projection, the object from making a contact with the liquid repellent film formed around the nozzle.

According to a third aspect of the present invention, there is provided a liquid-droplet jetting apparatus including: a channel unit in which a liquid channel is formed; and a nozzle plate which includes a nozzle communicating with the liquid channel, and a liquid repellent film formed on a liquid jetting surface in which an ejecting port of the nozzle is arranged;

wherein a projection which is higher than an area around the nozzle is formed on the liquid jetting surface of the nozzle plate; and a space which is independent from the liquid channel is formed between the projection of the nozzle plate and the channel unit.

According to the third aspect of the present invention, the space independent from the liquid channel is formed between the projection of the nozzle plate and the channel unit. This space can serve as a damper which attenuates a pressure wave propagating in the liquid channel when a liquid droplet is jetted. Therefore, by providing the space independently from the channel unit, it is possible to quickly attenuate the pressure wave propagating in the liquid channel, and to maintain liquid-droplet jetting characteristics satisfactorily.

In the liquid-droplet jetting apparatus of the present invention, a pressurized fluid may be filled in the independent space. In this case, even when the thickness of the nozzle plate at the projection is comparatively thin or decreased, the pressurized fluid is filled in the space between the projection and the channel unit. Accordingly, the projection can maintain sufficient strength against a force pushing the projection.

According to a fourth aspect of the present invention, there is provided a method of producing a liquid-droplet jetting apparatus including a channel unit in which a liquid channel is formed; and a nozzle plate which includes a nozzle communicating with the liquid channel, and a liquid repellent film which is formed on a liquid jetting surface in which an ejecting port of the nozzle is arranged, the method including:

a joining step of joining a surface of the nozzle plate on a side opposite to the liquid jetting surface, to the channel unit, at a joining portion of the nozzle plate; and a projection forming step of forming a projection by curving a non-joining portion of the nozzle plate, which is not joined to the channel unit, toward a side opposite to the channel unit as compared with an area around the nozzle.

According to the fourth aspect of the present invention, the projection is formed by outwardly inflating the non-joining portion which is not joined to the channel unit, after joining the nozzle plate to the channel unit, for example, at the area around the nozzle. Therefore, the liquid repellent film formed around the nozzle is protected, by the projection, from the mechanical friction with the recording paper which is transported closely to the liquid jetting surface, and from the mechanical friction with the wiper which is activated during wiping or the like, thereby preventing the liquid repellent film in the vicinity of the nozzle from being damaged. Further, in the present invention, the projection is formed by inflating the non-joining portion which is away from the area around the nozzle, toward the side opposite to the channel unit. Therefore, as compared to a conventional case of forming the recess by subjecting the area around the nozzle to the laser processing, no precise accuracy control is required, thereby making it possible to form the projection easily.

The method of producing the liquid-droplet jetting apparatus of the present invention, may further include, before the joining step, a recess forming step of forming a recess in a portion of the nozzle plate facing the non-joining portion or a portion of the channel unit facing the non-joining portion; wherein in the joining step, the nozzle plate may be joined to the channel unit, in a state in which a space is formed, by the recess, between the non-joining portion of the nozzle plate and the channel unit; and in the projection forming step, a fluid may be supplied into the space, and the projection may be formed by curving the non-joining portion toward the side opposite to the channel unit with the fluid. In this case, since the fluid is supplied into the space between the non-joining portion of the nozzle plate and the channel unit, and the projection is formed by inflating the non-joining portion with this fluid, the projection can be formed easily.

In the method of producing the liquid-droplet jetting apparatus of the present invention, the nozzle plate may be formed of a synthetic resin material. Thus, when the nozzle plate is made of the synthetic resin material having the low stiffness, the formation of the projection by deforming the non-joining portion becomes easy.

In the method of producing the liquid-droplet jetting apparatus of the present invention, in the projection forming step, the projection may be formed by curving the non-joining portion toward the side opposite to the channel unit, by locally heating the non-joining portion by a laser. By using a laser forming processing in which an object to be processed is shaped to have a desired shape by locally heating the object, the projection can be formed easily even when the nozzle plate is made of a material having a high stiffness, such as a metallic material.

The method of producing the liquid-droplet jetting apparatus of the present invention may further include, after the projection forming step, a filling step of filling a filling material between the non-joining portion of the nozzle plate and the channel unit. Thus, by filling the filling material between the channel unit and the non-joining portion, after forming the projection, it is possible to suppress the deformation of the projection due to being pressed by the wiper during wiping.

BRIEF DESCRIPTION OF THE DRAWINGS

FIGS. 7A to 7E show a producing process of the ink-jet head, wherein FIG. 7A shows a joining step of joining a vibration plate to plates which form a channel unit; FIG. 7B shows a joining step of a nozzle plate; FIG. 7C shows a liquid-repellent film forming step; FIG. 7D shows a projection forming step; and FIG. 7E shows a forming step of a piezoelectric layer and individual electrodes;

FIGS. 13A and 13B show a producing process of an ink-jet head of a sixth modified embodiment, wherein FIG. 13A shows a joining step of a nozzle plate, and FIG. 13B shows a projection forming step;

DETAILED DESCRIPTION OF THE PREFERRED EMBODIMENTS

Figure 1:
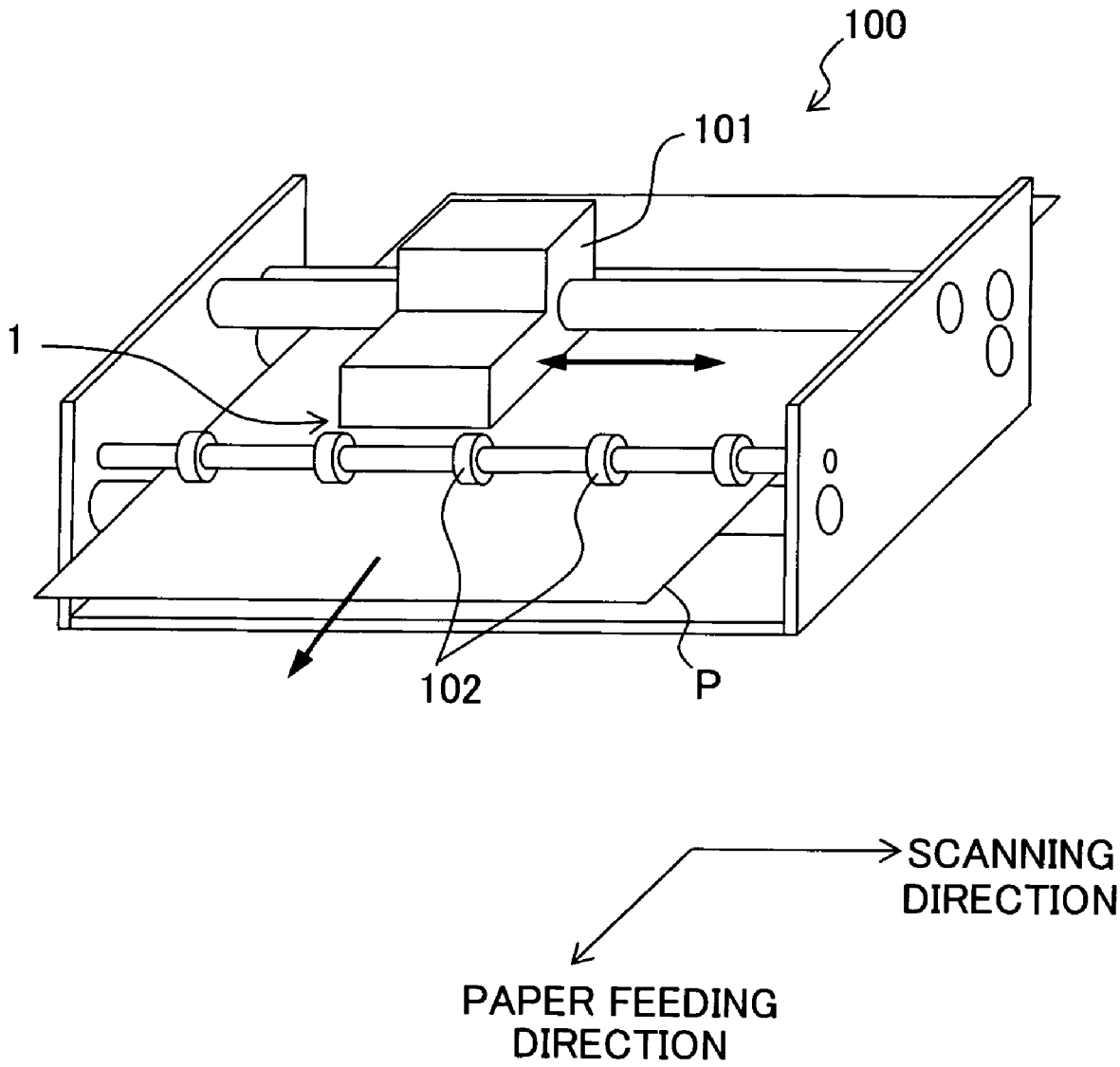
FIG. 1 is schematic structural diagram of an ink-jet printer according to an embodiment of the present invention.

An embodiment of the present invention will be described below. The embodiment is an example in which the present invention is applied to an ink-jet head which jets or discharges ink onto a recording paper, as a liquid-droplet jetting apparatus. Firstly, an ink-jet printer 100 which includes an ink-jet head 1 will be described briefly. As shown in FIG. 1, the ink-jet printer 100 includes a carriage 101 movable in a scanning direction (left and right direction) in FIG. 1, the ink-jet head 1 of a serial type which is provided on the carriage 101 and discharges ink onto a recording paper P, and transporting rollers 102 which transports the recording paper P forward in a paper feeding direction in FIG. 1. The ink-jet head 1 moves integrally with the carriage 101 in the scanning direction, and discharges ink onto the recording paper P from ejecting ports of nozzles 20 (see FIG. 3) formed in an ink jetting surface 41 (liquid-droplet jetting surface: see FIGS. 3, 5, and 6) of a lower surface of the ink-jet head 1. The recording paper P with a character and/or an image recorded thereon by the ink-jet head 1 is discharged forward in the paper feeding direction by the transporting rollers 102.

Next, the ink-jet head 1 will be described in detail with reference to FIGS. 2 to 6. As shown in FIGS. 2 to 6, the ink-jet head 1 includes a channel unit 2 in which a plurality of individual ink channels 21, each including a pressure chamber 16 (see FIG. 5), are formed; a nozzle plate 15 having a plurality of nozzles 20 (individual nozzles, jetting nozzles) communicating with the individual ink channels 21 respectively; and a piezoelectric actuator 3 which is arranged on the upper surface of the channel unit 2.

Figure 5:
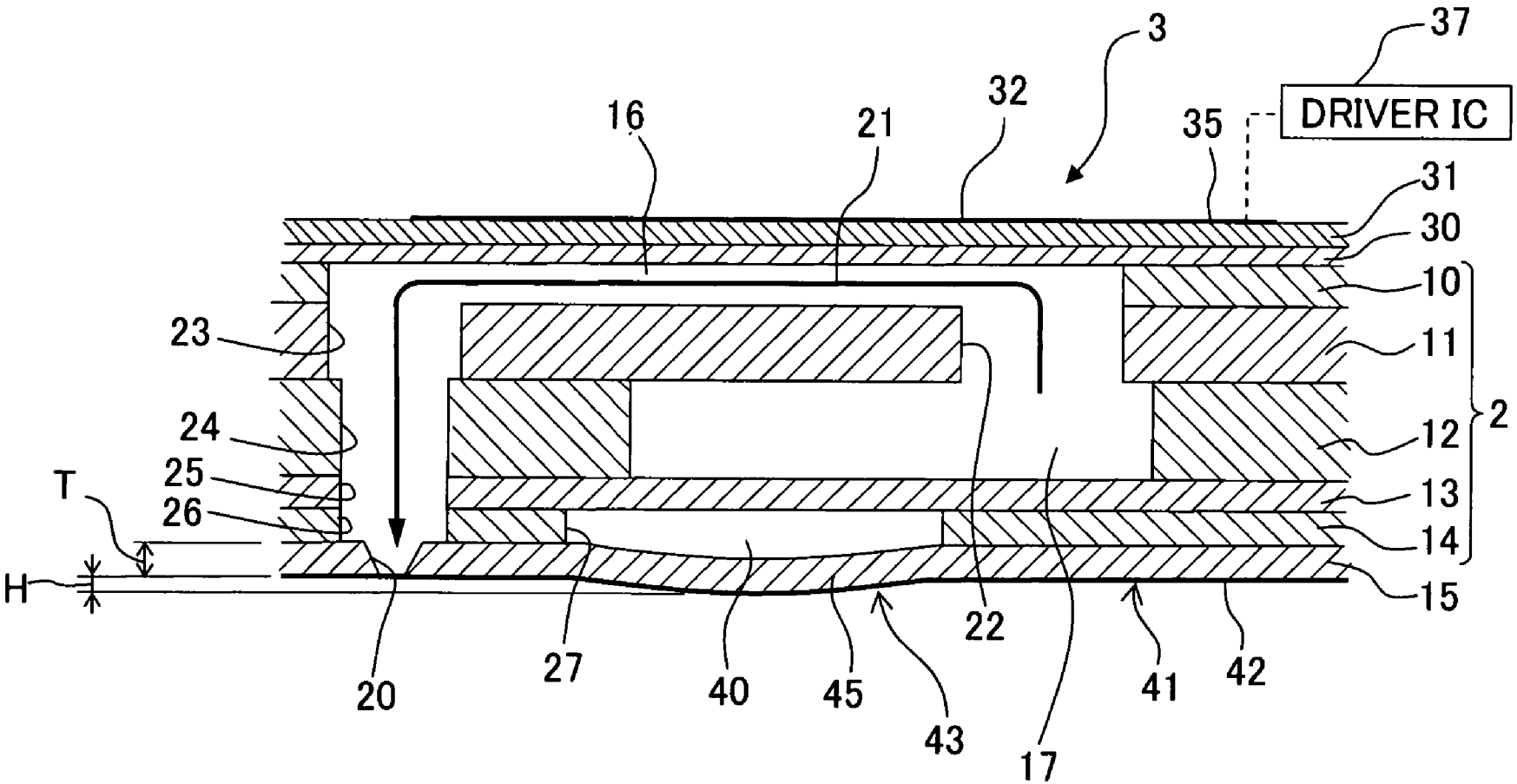
FIG. 5 is a cross-sectional view taken along a line V-V in FIG. 4.
Figure 6:
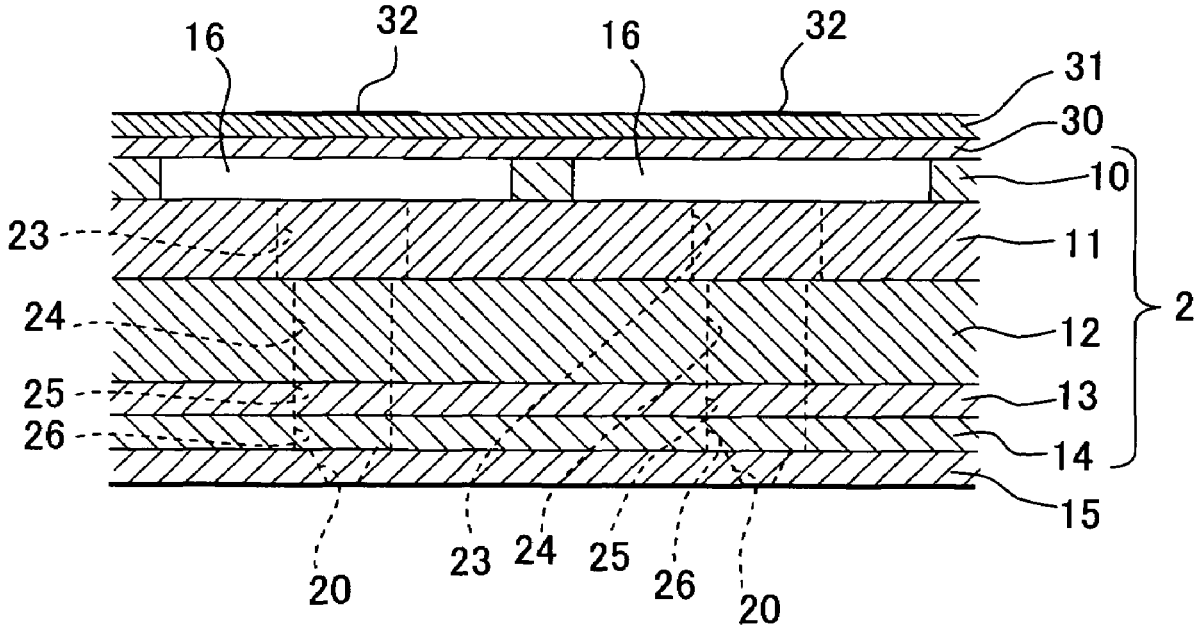
FIG. 6 is a cross-sectional view taken along a line VI-VI in FIG. 4.

The channel unit 2 will be described below. As shown in FIGS. 5 and 6, the channel unit 2 includes a cavity plate 10, a base plate 11, a manifold plate 12, and two cover plates 13, 14. These five plates 10 to 14 are joined in stacked layers. Further, these five plates 10 to 14 are stainless steel plates, and ink channels such as a manifold 17 and a pressure chamber 16 which will be described later, can be formed easily in these plates by etching. A nozzle plate 15, in which the plurality of nozzles 20 is formed, is joined to the lower surface of the channel unit 2 (lower surface of the cover plate 14).

Figure 2:
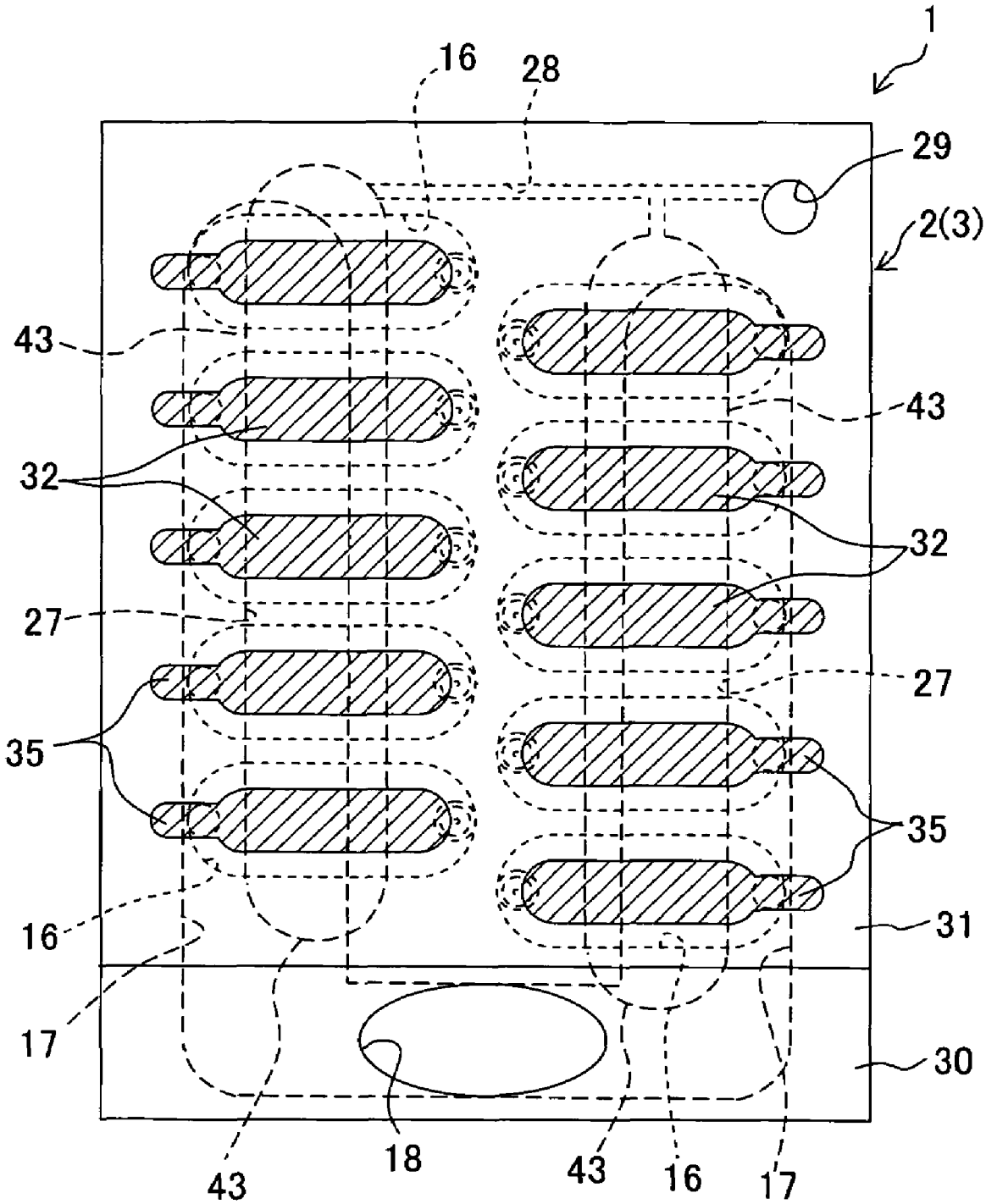
FIG. 2 is a plan view of an ink-jet head.
Figure 4:
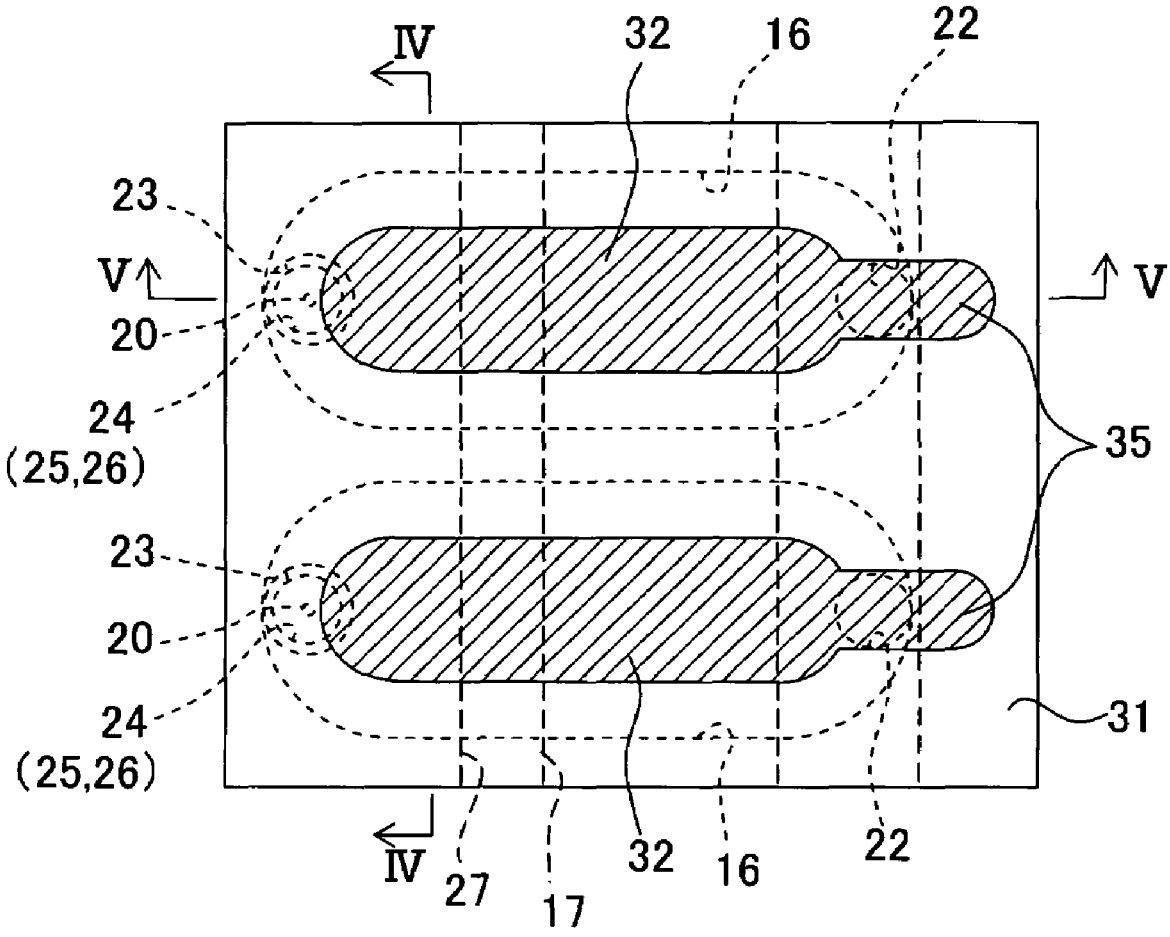
FIG. 4 is a partially enlarged plan view of FIG. 2.

As shown in FIGS. 2 and 4, in the cavity plate 10, the pressure chambers 16 arranged adjacently to one another along a plane are formed, and these pressure chambers 16 are open upwardly. Further, the pressure chambers 16 are arranged in two rows in the paper feeding direction (up and down direction in FIG. 2). Each of the pressure chambers 16 is formed to be substantially elliptical in shape which is long in the scanning direction (left and right direction in FIG. 2) in a plan view.

As shown in FIGS. 4 and 5, communicating holes 22 and 23 are formed in the base plate 11 at positions which overlap in a plan view with both end portions, respectively, in a longitudinal axis direction of each of the pressure chambers 16. Further, in the manifold plate 12, the manifold 17 (common liquid chamber) which is extended in the paper feeding direction (up and down direction in FIG. 2) is formed. As shown in FIGS. 2, 3, 5 and 6, the manifold 17 is arranged such that the manifold 17 overlaps in a plan view with left halves of the pressure chambers 16 arranged on a left side, and right halves of the pressure chambers 16 arranged on a right side, and communicates with the pressure chambers 16 via the communicating holes 22. The manifold 17 is covered by the cover plate 13 from a lower side. An ink supply port 18, formed in a vibration plate 30 which will be described later, is connected to the manifold 17, and ink is supplied to the manifold 17 from an ink tank (omitted in the diagram) via the ink supply port 18. Furthermore, a plurality of communicating holes 24, communicating with the communicating holes 23 in the base plate 11 respectively, are formed in the manifold plate 12 at positions each of which overlaps in a plan view with an end portion of one of the pressure chambers 16, the end portion being on a side of the pressure chamber opposite to the manifold 17.

Figure 3:
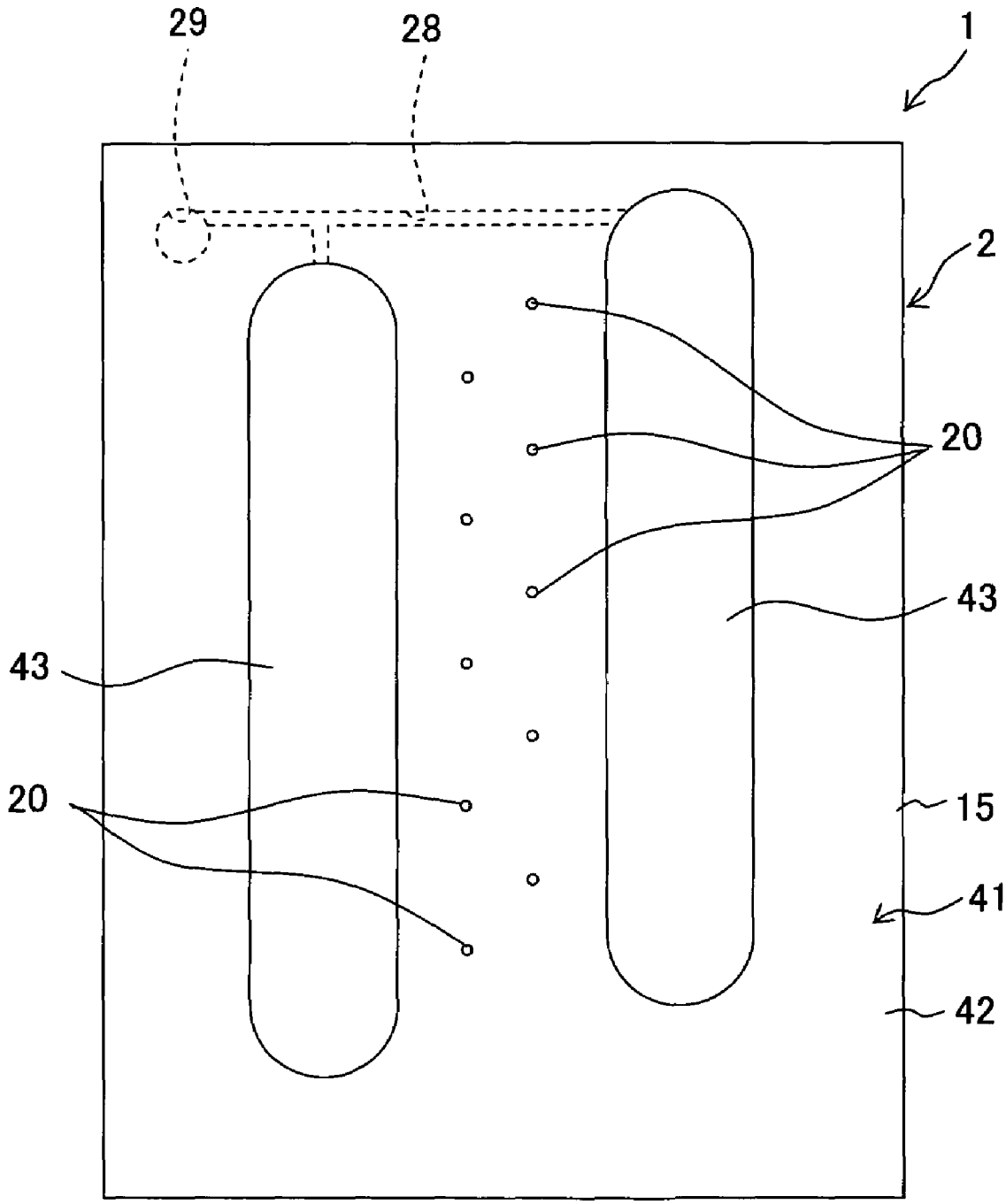
FIG. 3 is a bottom view of the ink-jet head.

In the two cover plates 13 and 14, communicating holes 25 and 26 are formed respectively, at positions overlapping in a plan view with the communicating holes 23 and 24. Further, as shown in FIGS. 2, 3 and 5, two through holes 27 (space-forming holes), each of which overlaps with central portions of the pressure chambers 16 arranged in one of the two rows and extends in the paper feeding direction, are formed at areas of the cover plate 14 disposed on a lower side, the areas being away from the communicating holes 26 outwardly in the scanning direction. Furthermore, as shown in FIG. 2, the through holes 27 are arranged such that a substantial portion of each of the through holes 27 overlaps in a plan view with the manifold 17, with respect to a width direction (scanning direction).

The nozzle plate 15 is made of a high-molecular synthetic resin material such as polyimide. As shown in FIGS. 2 and 3, each of the nozzles 20 is formed in the nozzle plate 15 at a position overlapping in a plan view with the communicating hole 23 (24, 25, and 26). In other words, the nozzles 20 are arranged in two rows in the paper feeding direction (up and down direction in FIGS. 2 and 3: first direction), the nozzles 20 corresponding to the pressure chambers 16 respectively. The nozzle plate 15 is joined by an adhesive to the lower surface of the cover plate 14 at a portion which is other than a portion facing one of the two through holes 27 (and which includes an area in the vicinity of the nozzles 20). In other words, the portion of the nozzle plate 15, facing one of the two through holes 27 in the cover plate 14 is a non-joining portion 45 which is not joined to the cover plate 14; and between this non-joining portion 45 and the channel unit 2, a space 40, which corresponds to one of the through holes 27 in the cover plate 14 (first plate), is formed. Furthermore, the space 40 is partitioned by the cover plate 13 (second plate) from the manifold 17 (common liquid chamber) which is a part of the ink channel. In other words, the space 40 does not communicate with the manifold 17, and the space 40 and the manifold 17 are mutually independent.

Further, as shown in FIG. 2, a communicating channel 28 which allows the space 40 to communicate with an outside, via an air supply port 29 formed in the vibration plate 30 which will be described later, is formed in the channel unit 2. By connecting the air-supply port 29 to a pressurizing means (omitted in the diagram) such as an air pump, and supplying pressurized air into the space 40 in each of the two through holes 27 via the air-supply port 29 and the communicating channel 28, it is possible to form a projection 43 projecting downward, in the nozzle plate 15. The projection 43 will be explained later in detail.

As shown in FIGS. 3, 5, and 6, a liquid repellent film 42 which has a high liquid repellent property to prevent wetting by the ink is provided entirely on the ink jetting surface 41 (liquid-droplet jetting surface), on the lower surface of the nozzle plate 15, in which the ejecting ports of the nozzles 20 are formed. The liquid repellent film 42 is formed by coating, for example, a fluororesin.

Further, as shown in FIG. 5, the manifold 17 communicates with each of the pressure chambers 16 via one of the communicating holes 22, and further, each of the pressure chambers 16 communicates with one of the nozzles 20 via the communicating holes 23 to 26. Thus, individual ink channels 21 each from the manifold 17 up to one of the nozzles 20 via one of the pressure chambers 16 are formed inside the nozzle plate 15 and the channel unit 2.

Although not specifically shown in FIG. 1, a purge unit which performs a purge operation of jetting the ink forcibly from the nozzle 20 when the nozzle 20 is blocked, is provided in the ink-jet printer 100 of the embodiment. This purge unit is arranged in the ink-jet head 1 at a position outside of an area, in which the recording paper P is transported, with respect to the scanning direction (left and right direction in FIG. 1). Further, the purge unit includes a cap which covers the ink jetting surface 41 of the ink-jet head 1, a purge pump which is connected to the cap, and a wiper which is movable in the scanning direction relative to the ink-jet head 1. Furthermore, when the purge operation is performed by the purge unit, the ink-jet head 1 is moved up to a position over the purge unit, and after fitting the cap to cover the ink jetting surface 41, the ink is sucked out by the purge pump from each nozzle 20. Afterwards, by moving the wiper relative to the ink-jet head 1 in the scanning direction, the ink and/or dust or the like adhered to the ink jetting surface 41 are removed (wiping).

Since the recording paper P is transported by leaving a very small gap (about 1 mm for example) from the ink jetting surface 41, there is a fear that the recording paper P comes into contact with the ink jetting surface 41 when being transported, thereby damaging the liquid repellent film 42 by being partially exfoliated or the like. Further, during the wiping operation by the wiper, there is also a fear that the liquid repellent film 42 is damaged by a mechanical friction with the wiper moving in the scanning direction. In a case that damage such as an exfoliation occurs to the liquid repellent film 42 around a certain nozzle 20 due to such factors, when pressure is applied to the ink in the pressure chamber 16 by the piezoelectric actuator 3 which will be described later and when the ink is jetted from the certain nozzle 20, there is a fear that a jetting direction of ink from the certain nozzle 20 is inclined with respect to a jetting normal direction, and thus the printing quality is declined.

As shown in FIGS. 2 to 5, in this embodiment, in each of the non-joining portions 45 of the nozzle plate 15, which is at positions away from the nozzles 20, and not joined to the channel unit 2 (cover plate 14), the projection 43 which is inflated downwardly (direction opposite to the channel unit 2), more than an area around the nozzles 20 is formed. Further, as shown in FIGS. 2 and 3, the two projections 43 are arranged at areas, respectively, the areas being located at both sides of the area formed with the nozzles 20 respectively and being outside the area formed with the nozzles, with respect to the scanning direction orthogonal to the paper feeding direction that is a direction in which the nozzles 20 are aligned; and each of the two projections 43 is extended in the paper feeding direction.

Therefore, due to these two projections 43, the recording paper P which is transported closely to the ink jetting surface 41, and the wiper which comes in contact with the ink jetting surface 41 during wiping, or the like, hardly make a contact with the liquid repellent film 42 formed around the nozzles 20, and the damage of the liquid repellent film 42 around the nozzles 20 can be prevented as much as possible. Further, the two projections 43 are formed in the areas respectively, the areas being located at both sides of the area formed with the nozzles 20 respectively, and being outside the area formed with the nozzles 20, with respect to the scanning direction. Accordingly, it is also possible to assuredly prevent the wiper moving in the scanning direction during the wiping from making a contact with the liquid repellent film 42 around the nozzles 20.

Each of the two projections 43 is formed by supplying pressurized air into the space 40 which is formed between the channel unit 2 and the non-joining portion 45 of the nozzle plate 15, and inflating, by the air, the non-joining portion 45 toward the side opposite to of the channel unit 2 (downwardly). The forming of the projections 43 will be described in detail in a producing process which will be described later. A projecting height H of the projection 43 is about 1/10 (about 5 μm) of a thickness T (about 50 μm, for example) of the nozzle plate 15.

Further, as shown in FIG. 5, a surface of the projection 43 is formed as a continuously smooth curved surface. In other words, there is no level difference on the surface of the projection 43. Therefore, during the wiping, the ink and dust or the like adhered to the ink jetting surface 41 can be removed easily by the wiper.

Next, the piezoelectric actuator 3 will be described. As shown in FIG. 2 and FIGS. 4 to 6, the piezoelectric actuator 3 includes a vibration plate 30 arranged on the upper surface of the cavity plate 10, a piezoelectric layer 31 provided on the upper surface of the vibration plate 30, and a plurality of individual electrodes 32 provided on the upper surface of the piezoelectric layer 31, corresponding to the pressure chambers 16 respectively.

The vibration plate 30 is a plate having a substantially rectangular shape in a plan view, and is made of a metallic material such as an iron alloy such as stainless steel, a copper alloy, a nickel alloy, or a titanium alloy. The vibration plate 30 is arranged on the upper surface of the cavity plate 10 so as to cover the pressure chambers 16, and is joined to the cavity plate 10. Further, the vibration plate 30 made of a metal is electroconductive, and is always kept at a ground electric potential. Furthermore, the vibration plate 30 also serves as a common electrode which causes an electric field to act in the piezoelectric layer 31 sandwiched between the vibration plate 30 and the individual electrode 32.

The piezoelectric layer 31 which is mainly composed of lead zirconate titanate (PZT) which is a solid solution of lead titanate and lead zirconate, and is a ferroelectric material is arranged on the upper surface of the vibration plate 30. As shown in FIG. 4 and FIG. 6, the piezoelectric layer 31 is formed on the upper surface of the vibration plate 30, spreading continuously across the pressure chambers 16.

The individual electrodes 32 which are elliptical, flat, and smaller to some extent than the pressure chamber 16 are formed on the upper surface of the piezoelectric layer 31. The individual electrodes 32 are formed at positions each of which overlaps in a plan view with a central portion of one of the pressure chambers 16. In other words, as shown in FIG. 2, the individual electrodes 32 are arranged in two rows in the paper feeding direction (up and down direction in FIG. 2) corresponding to the pressure chambers 16 respectively. Further, the individual electrodes 32 are made of an electroconductive material such as gold, copper, silver, palladium, platinum, or titanium. Furthermore, a plurality of wiring portions 35 are formed on the upper surface of the piezoelectric layer 31. Each of the wiring portions 35 extends, parallel to a longitudinal direction (left and right direction in FIG. 2) of one of the individual electrodes 32, from an end portion of the individual electrode 32 on a side of the manifold 17. As shown in FIG. 5, each of the wiring portions 35 is electrically connected to a driver IC 37 via a wiring member having flexibility, such as a flexible printed circuit (FPC) A drive voltage is applied selectively to the individual electrodes 32 from the driver IC 37 via the wiring portions 35.

Next, an action of the piezoelectric actuator 3 during an ink discharge operation will be explained. When the drive voltage is selectively applied from the driver IC 37 to the individual electrodes 32, the electric potential of the individual electrode 32 disposed on the upper side of the piezoelectric layer 31 to which the drive voltage is applied differs from the electric potential of the vibration plate 30 which is on a lower side of the piezoelectric layer 31, which is kept at a ground potential and which serves as the common electrode, and an electric field is generated in a vertical direction in a portion of the piezoelectric layer 31 which is sandwiched between the individual electrode 32 and the vibration plate 30. At this time, when a direction in which the piezoelectric layer 31 is polarized and the direction of the electric field are the same, the piezoelectric layer 31 is contracted in a horizontal direction which is orthogonal to the vertical direction which is the direction in which the piezoelectric layer 31 is polarized. Since the vibration plate 30 is joined to the cavity plate 10, with the contraction of the piezoelectric layer 31, the vibration plate 30 is deformed to project toward the pressure chamber 16. Therefore, a volume in the pressure chamber 16 is decreased, and pressure is applied to the ink in the pressure chamber 16, thereby ejecting a droplet of ink from a nozzle 20 communicating with the pressure chamber 16.

When the pressure is applied to the ink in the pressure chamber 16, a pressure fluctuation to some extent occurs in the manifold 17 which communicates with the plurality of pressure chambers 16. When this pressure fluctuation is substantial, there is a fear that variation in the characteristics of liquid-droplet jetting occurs, such as variation in the volume of liquid droplet and/or speed of liquid droplet jetted from a nozzle 20 which communicates with another pressure chamber 16. Therefore, it is desirable to quickly attenuate the pressure fluctuation. Here, in this embodiment, two through holes 27 (space-forming holes) are formed in the cover plate 14 (first plate) between the nozzle plate 15 and the cover plate 13 (second plate) such that a substantial portion of each of the through holes 27 is overlapped with the manifold 17. The space 40 in each of the two through holes 27 and the manifold 17 are partitioned by the cover plate 13, and the space 40 and the manifold 17 are mutually independent. In other words, since a portion of the cover plate 13, facing both the manifold 17 and one of the through holes 27, functions as a damper, the pressure fluctuation (change) in the manifold can be attenuated quickly.

Figure 7A:
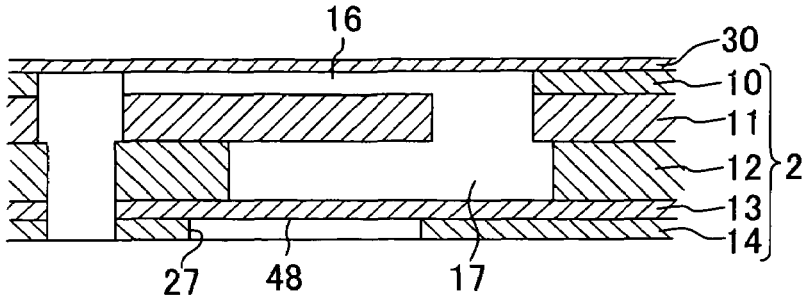

Next, a method of producing the ink-jet head 1 will be described with reference to FIGS. 7A to 7E. Firstly, ink channels such as the manifold 17 and the pressure chambers 16 are formed by etching in the five plates 10 to 14 which form the channel unit 2. At this time, the two through holes 27 are simultaneously formed in the cover plate 14, and the air supply port 29 and the communicating channel 28 (see FIGS. 2 and 3) communicating with the two through holes 27 are formed in the five plates 10 to 14 and the vibration plate 30. Further, as shown in FIG. 7A, these six plates including the five plates 10 to 14 and the vibration plate 30 are stacked in a laminated state and joined together, thereby making the channel unit 2. At this time, a recess 48 is formed in the channel unit 2 (recess forming step) by closing, by the cover plate 13, an opening of each of the through holes 27 in the cover plate 14, the opening being on a side of the pressure chamber 16.

Figure 7B:
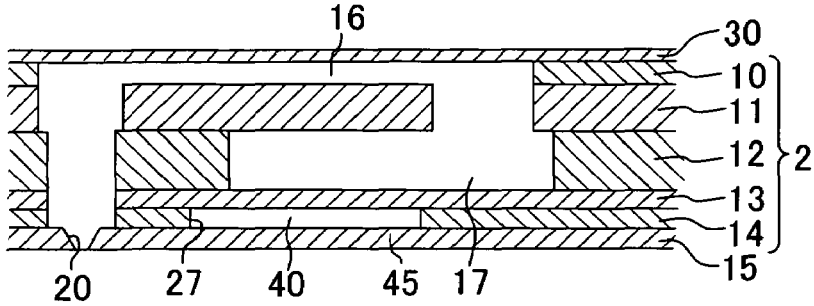
Figure 7C:
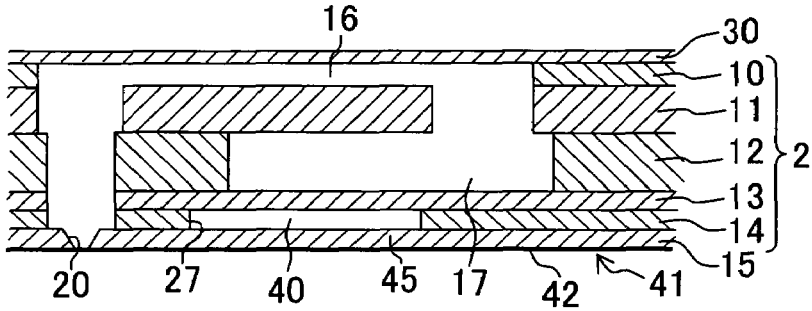

Next, by performing laser processing using an excimer laser or the like, the nozzles 20 are formed in a substrate made of a synthetic resin material such as polyimide, thereby making the nozzle plate 15. Further, as shown in FIG. 7B, the upper surface of the nozzle plate 15 (surface on a side opposite to the ink jetting surface 41) is joined to the cover plate 14 by an adhesive (joining step). At this time, while forming the space 40 between the nozzle plate 15 and the cover plate 13 by closing an opening of each of the through holes 27 on a side opposite to the pressure chambers 16 (opening of the recess 48) by the non-joining portion 45, the nozzle plate 15 is joined to the channel unit 2 at a portion (including a portion in the vicinity of the nozzles 20) other than the non-joining portion 45 facing one of the through holes 27. Furthermore, as shown in FIG. 7C, the liquid repellent film 42 made of a fluororesin is formed, by a method such as a spin coating, on the ink jetting surface 41 (lower surface of the nozzle plate 15) in which ejecting ports of the nozzles 20 are arranged. At the time of producing the nozzle plate 15, the liquid repellent film 42 may be formed in advance on the substrate before forming the nozzles 20.

Figure 7D:
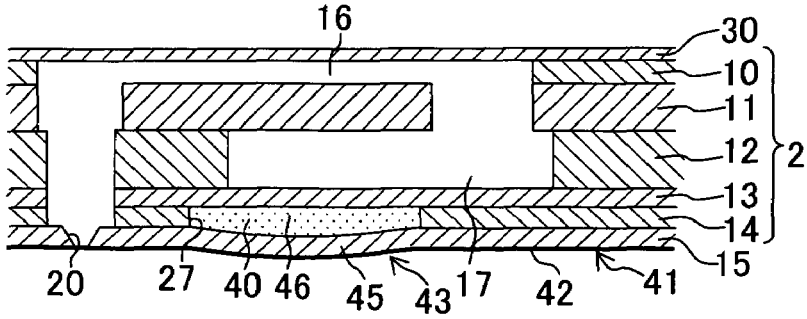

Next, as shown in FIG. 7D, pressurized air 46 is supplied into the space 40 in each of the through holes 27 via the air supply port 29 formed in the vibration plate 30 (see FIG. 2 and FIG. 3) and the communicating channel 28 formed in the channel unit 2 (see FIG. 2 and FIG. 3). The non-joining portion 45 of the nozzle plate 15 is deformed and inflated downward (direction opposite to the side of the channel unit 2), and a projection 43 projected in a smooth curved shape is formed (projection forming step). Here, since the nozzle plate 15 is made of a synthetic resin material having a low stiffness as compared to a metallic material, the non-joining portion 45 can be deformed by air at comparatively low pressure (about 0.1 MPa to 0.2 MPa for example). Accordingly, the formation of the projection 43 becomes easy. In addition, since the cover plate 13 is made of a metal, only the non-joining portion 45 of the nozzle plate 15 can be deformed without deforming a portion of the cover plate 13 which partitions the manifold 17 and the space 40. The projection 43 can also be formed by injecting, into the space 40, pressurized gas other than air or pressurized liquid such as water. Further, in a state that the non-joining portion 45 of the nozzle plate 15 is deformed, the deformation of the non-joining portion 45 of the nozzle plate 15 is fixed by heating the nozzle plate 15 to a temperature of about 150° C. to 250° C. By heating the nozzle plate 15 in such a manner, even when the pressure inside the space 40 is returned to a normal pressure later on, the non-joining portion 45 of the nozzle plate 15 can be retained in the deformed state.

Figure 7E:
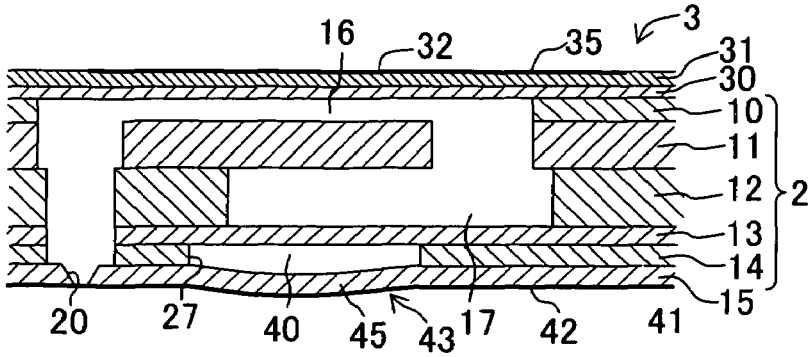

Further, as shown in FIG. 7E, the piezoelectric layer 31 is formed on the upper surface of the vibration plate 30. The piezoelectric layer 31 can be formed by an aerosol deposition method (AD method) in which particles of a piezoelectric material are deposited by blowing the particles onto the vibration plate 30 at a high speed together with a carrier gas. Alternatively, the piezoelectric layer 31 can be formed by using a sputtering method, a chemical vapor deposition method (CVD method), a sol-gel method, a solution coating method, and a hydrothermal synthesis method. Still alternatively, the piezoelectric layer 31 can be formed by adhering, on the vibration plate 30, a piezoelectric sheet obtained by baking a green sheet. A pattern of individual electrodes 32 and wiring portions 35 is formed on the upper surface of the piezoelectric layer 31 by a screen printing or the like.

In the above explanation, the projection 43 is formed by inflating the non-joining portion 45 (FIG. 7D) after forming the liquid repellent film 42 on the lower surface of the nozzle plate 15 (FIG. 7C). However, the liquid repellent film 42 may be formed on the lower surface of the nozzle plate 15 after forming the projection 43.

According to the ink-jet head 1 and the method of producing the ink-jet head 1 as explained above, the following effects are achieved. The nozzle plate 15 is joined to the channel unit 2 at the portion including the area around the nozzles 20, and further the projection 43 projected toward a side opposite to the channel unit 2 is formed in the non-joining portion 45 which is away from the area around the nozzles 20. Therefore, the recording paper P which is transported closely to the ink jetting surface 41 and/or the wiper which comes in contact with the ink jetting surface 41 during wiping hardly come in contact with the liquid repellent film 42 formed on the area around the nozzles 20. Therefore, it is possible to prevent the damage to the liquid repellent film 42 around the nozzles 20 as much as possible. Further, the two projections 43 are formed in the areas respectively, the areas being located at both sides of the area formed with the nozzles 20 respectively and being outside the area formed with the nozzles 20, with respect to the scanning direction. Therefore, it is possible to assuredly prevent the wiper which moves in the scanning direction during wiping from making contact with the liquid repellent film 42 around the nozzles 20 to cause damage of the liquid repellent film 42.

A surface of the projection 43 is formed to be a continuously smooth curved surface. Therefore, as compared to a case in which the projection 43 is formed in a shape having a level difference, the ink and/or dust or the like adhered to the ink jetting surface 41 can be removed easily during wiping.

The projection 43 is formed by supplying the pressurized air into the space 40 between the nozzle plate 15 and the channel unit 2 (cover plate 14) so as to make the non-joining portion 45, which is away from the area around the nozzles 20, to inflate downward. Therefore, as compared to a case of forming a recess by subjecting the area around the nozzles 20 to a special processing such as the laser processing, no precise accuracy control is required, and thus the projection 43 can be formed easily.

In this embodiment, the nozzles 20 are provided in rows along the direction (paper feeding direction) orthogonal to the scanning direction of the ink-jet head 1. Since the ink-jet printer 100 of this embodiment is a serial type printer, the ink-jet head 1 jets the ink while moving in the scanning direction. At this time, when a scanning speed at which the ink-jet head 1 moves in the scanning direction, and a paper feeding speed at which the recording paper is fed in the paper feeding direction are compared, the scanning speed is overwhelmingly faster than the paper feeding speed. Therefore, by arranging the projections 43 at upstream and downstream sides respectively in the scanning direction with respect to the nozzle 20, it is possible to enhance the effect of preventing, by the projection 43, the damage of the liquid repellent film 42 around the nozzles 20. On the other hand, in a case of a line printer, since the recording paper is fed at a high speed, by providing the projections at upstream and downstream sides respectively of the paper feeding direction with respect to the nozzle, it is possible to enhance the effect of preventing, by the projection, the damage of the liquid repellent film 42 around the nozzles. Normally, in a serial type ink-jet head, the nozzles are arranged in a row along the paper feeding direction; and in a line type ink-jet head, the nozzles are arranged in a row along the direction orthogonal to the paper feeding direction. Therefore, in these cases, by providing the projection parallel to the direction in which the nozzles are arranged, it is possible to enhance the effect of preventing, by the projection, the damage of the liquid repellent film around the nozzles.

Next, modified embodiments in which various modifications are made in the embodiment will be explained. Same reference numerals will be used for parts or components having a similar structure as those in the embodiment, and the description of such parts or components will be omitted when deemed appropriate.

First Modified Embodiment

Figure 8:
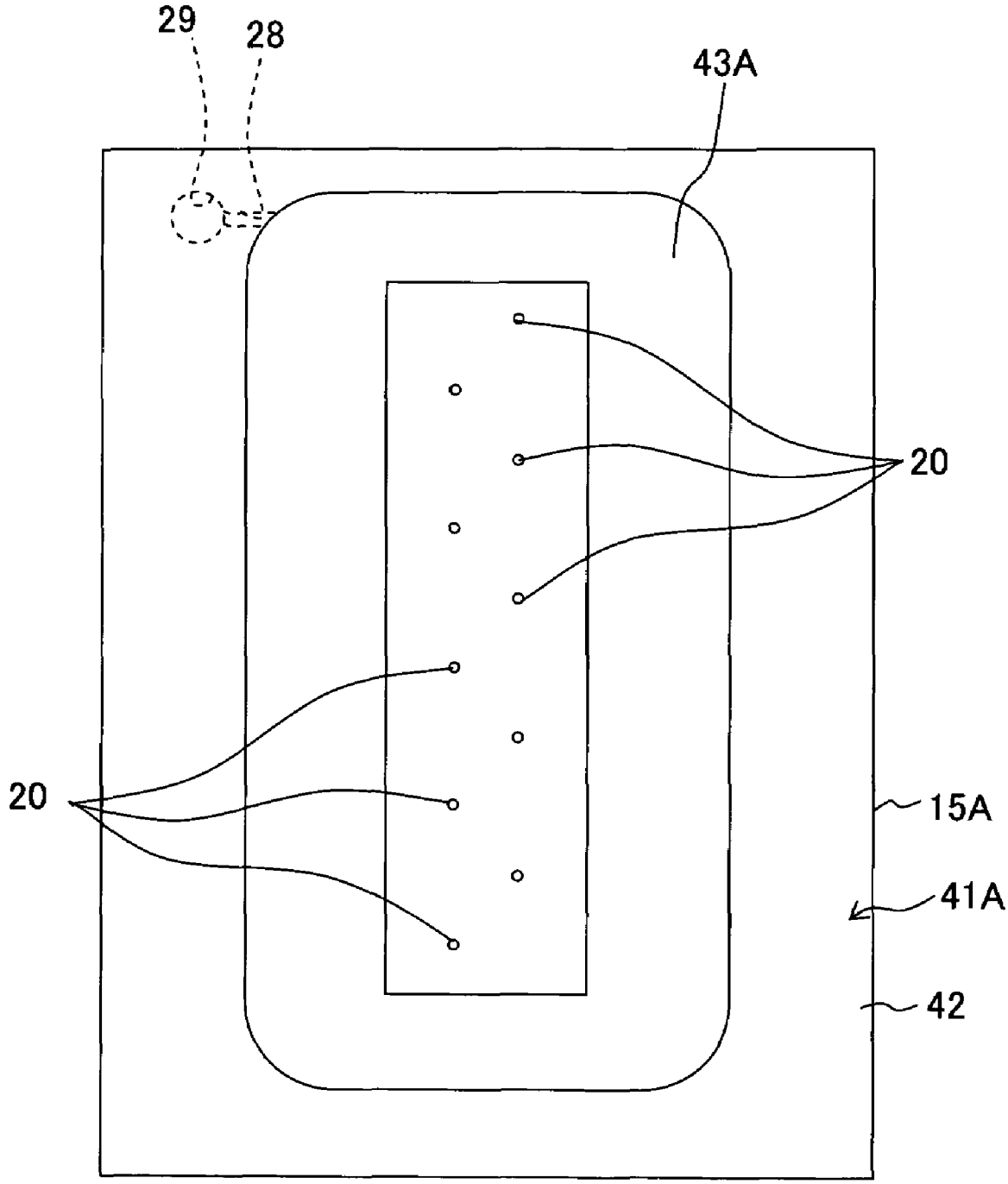
FIG. 8 is a bottom view of an ink-jet head of a first modified embodiment.

As shown in FIG. 8, a projection 43A may be formed on an ink jetting surface 41A of a nozzle plate 15A, in an annular shape (ring shape) so as to surround the area in which the nozzles 20 are formed. In this structure, when the recording paper P (see FIG. 1) is transported in the paper feeding direction (up and down direction in FIG. 8), the recording paper P hardly comes in contact with the liquid repellent film 42 at a portion in the vicinity of the nozzles 20, and thus the damage of the liquid repellent film 42 can be prevented more assuredly.

Second Modified Embodiment

Figure 9:
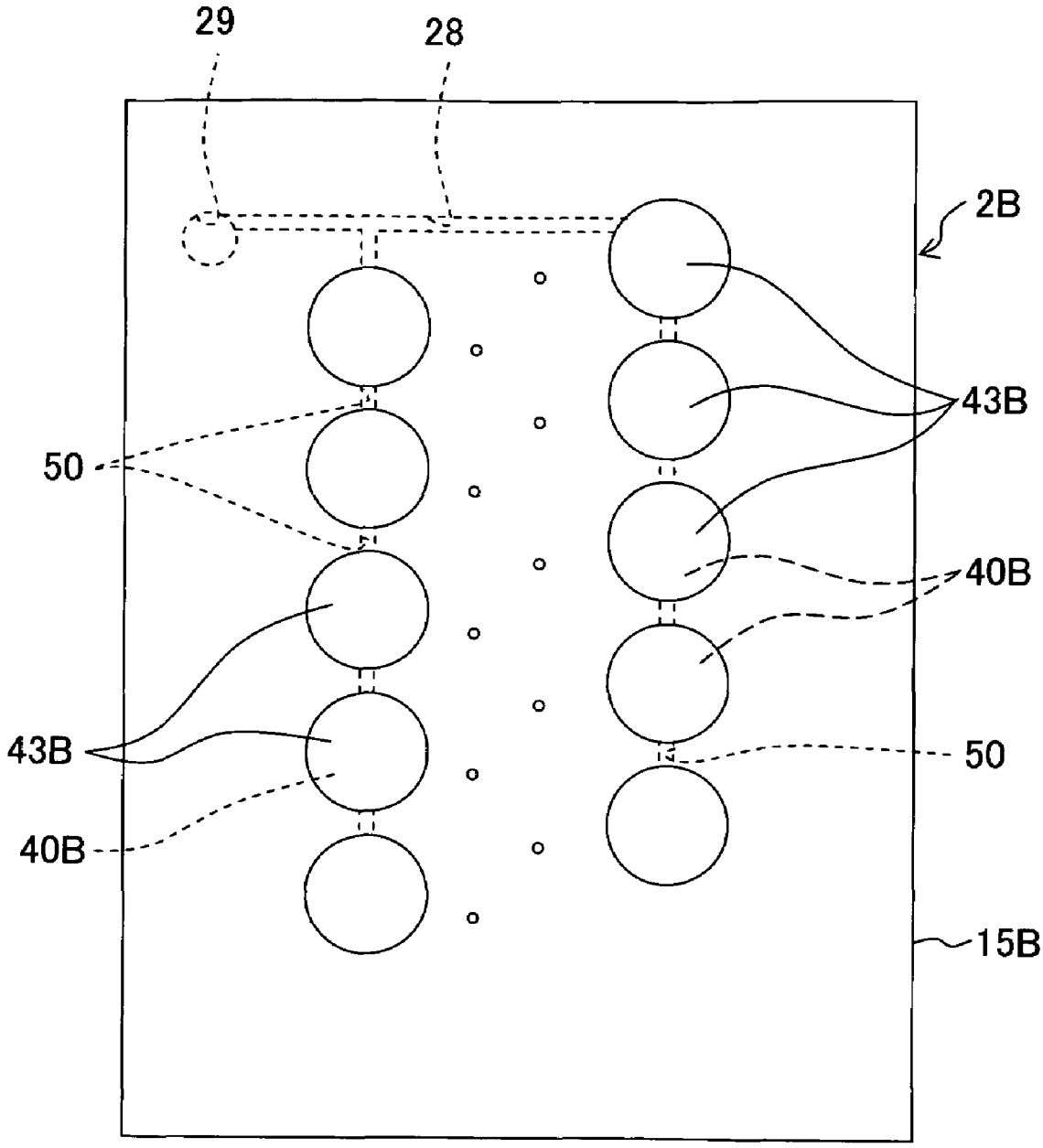
FIG. 9 is a bottom view of an ink-jet head of a second modified embodiment.

It is not necessarily indispensable that the projection is formed such that the projection is extended continuously parallel to the direction in which the nozzles are aligned or arranged. For example, as shown in FIG. 9, a plurality of projections 43B having a circular shape may be aligned discretely parallel to the direction in which the nozzles 20 are aligned (paper feeding direction), the projections 43B being formed in areas which are located at both sides of the area in which the nozzles 20 are arranged, and are outside the area in which the nozzles 20 are arranged. In this second modified embodiment, a plurality of spaces 40B are formed between a nozzle plate 15B and a channel unit 2B, and these spaces 40B communicate with one another by communicating channels 50. Further, by supplying the air supplied from one air supply port 29 into each of the spaces 40B via the communicating channels 28 and 50, a plurality of projections 43 is formed.

Third Modified Embodiment

Figure 10:
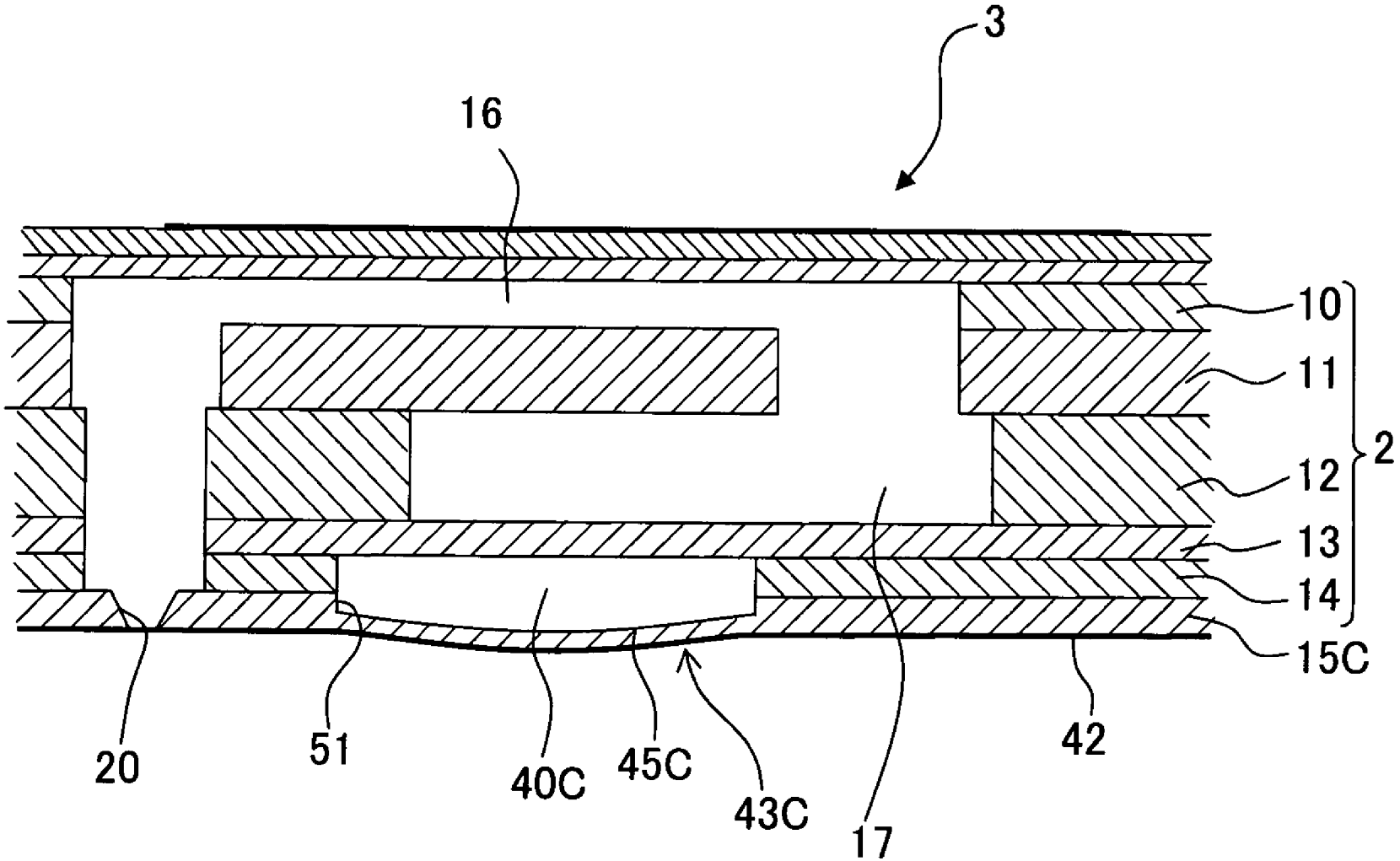
FIG. 10 is a cross-sectional view of a third modified embodiment, corresponding to FIG. 5.

A thickness of a joining portion of the nozzle plate may be thinner or less than a thickness of other portion of the nozzle plate. For example, as shown in FIG. 10, a groove 51 may be formed in an inner side (side of the channel unit 2) of a non-joining portion 45C of a nozzle plate 15C, and a thickness of a portion in which the groove 51 is formed may be thinner than a thickness of the other portion of the nozzle plate 15C. In this structure, inflating the non-joining portion 45C by the air supplied into a space 40C becomes easy, thereby making it easy to form a projection 43C.

Fourth Modified Embodiment

Figure 11:
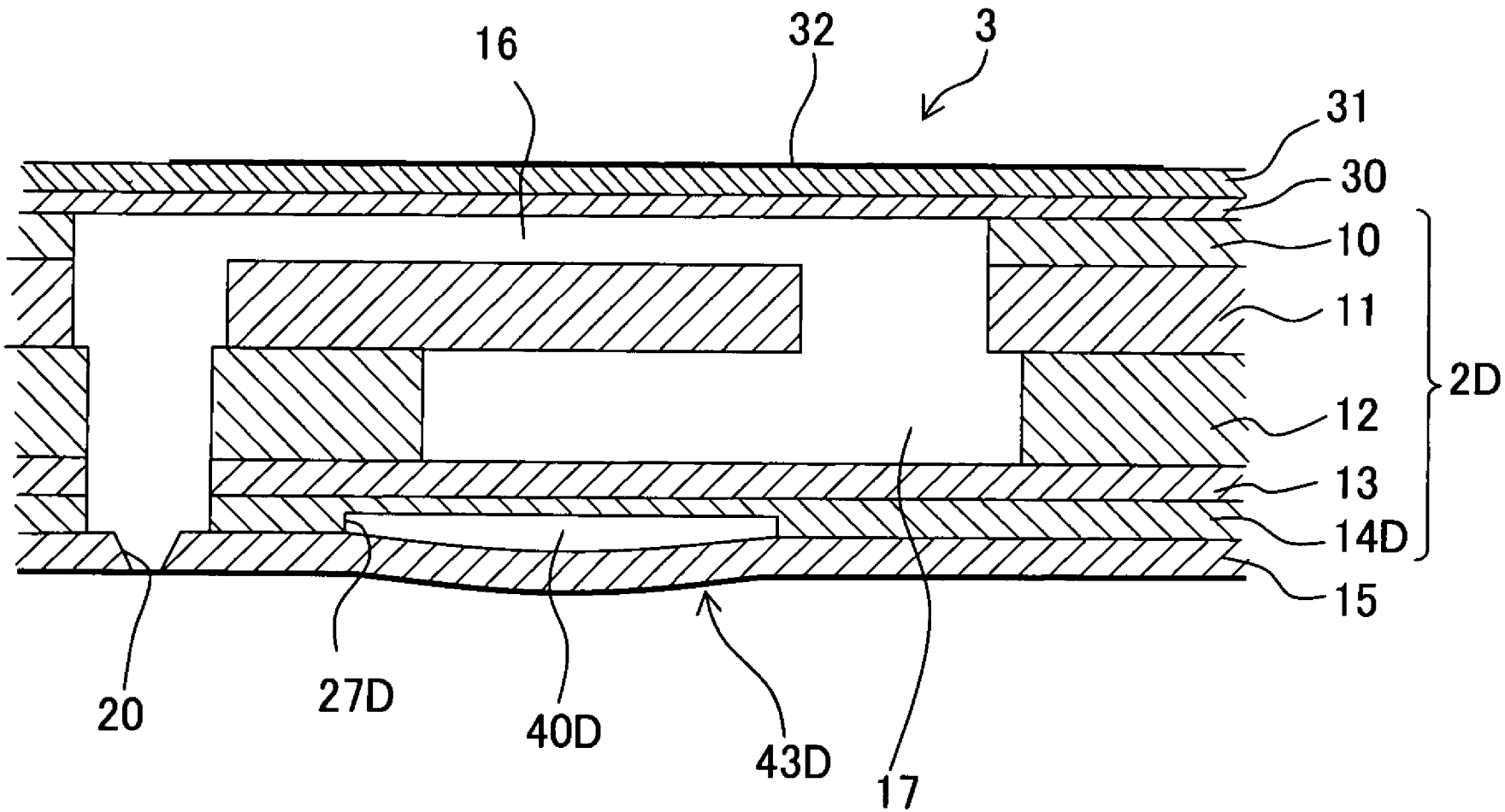
FIG. 11 is a cross-sectional view of a fourth modified embodiment, corresponding to FIG. 5.

In the embodiment as described above, the space 40 for which a fluid such as air is supplied is formed between the channel unit 2 and the nozzle plate 15 by providing the through hole 27 in the cover plate 14 of the channel unit 2 so as to form a recess on a side of the channel unit 2 (see FIG. 5). However, as shown in FIG. 11, a space 40D may be formed between a channel unit 2D and the nozzle plate 15 by providing a groove 27D (recess), instead of the through hole 27, in a lower surface of a cover plate 14D, and a projection 43D may be formed by supplying air or the like into the space 40D.

Fifth Modified Embodiment

Figure 12:
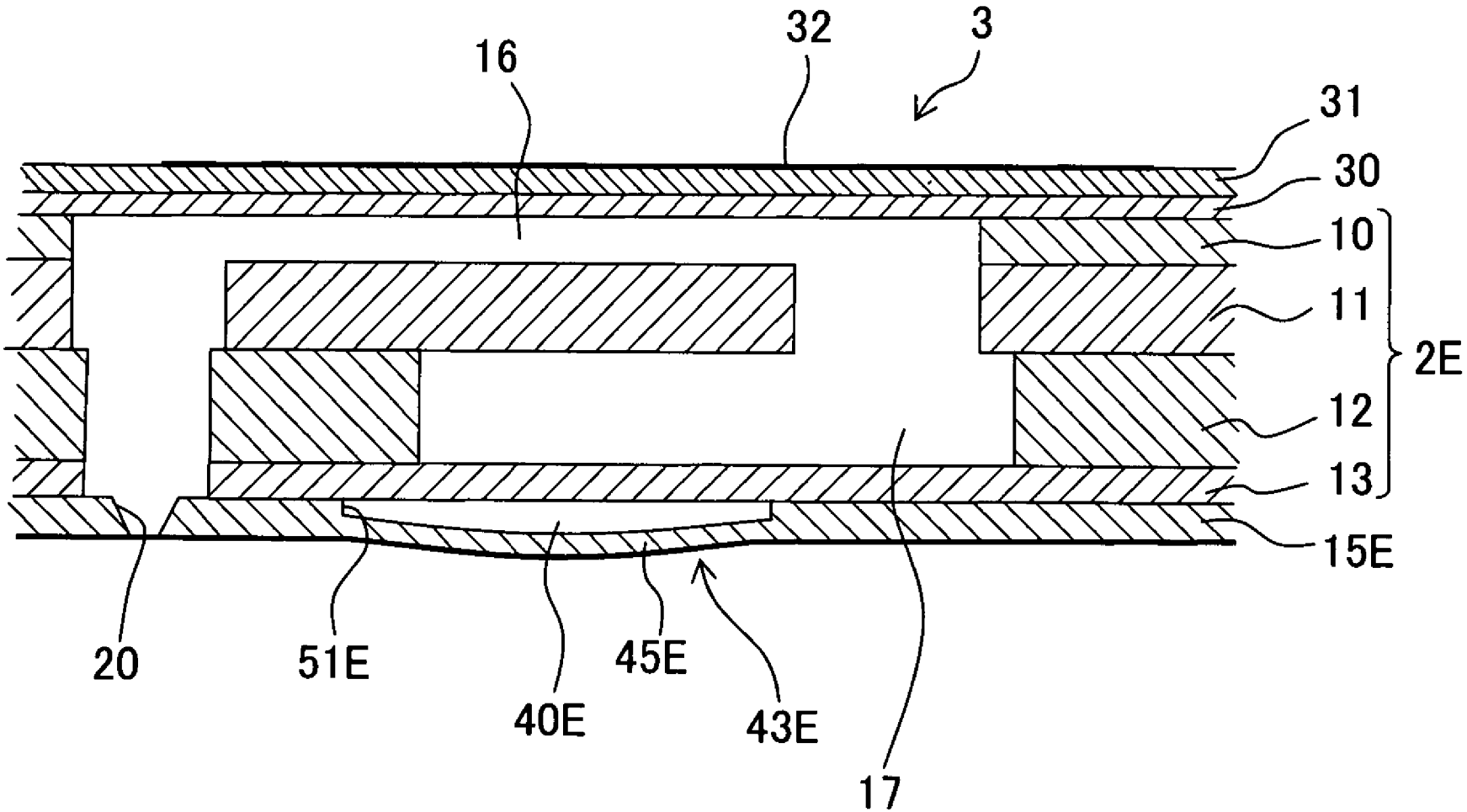
FIG. 12 is a cross-sectional view of a fifth modified embodiment, corresponding to FIG. 5.

Alternatively, as shown in FIG. 12, a space 40E may be formed between a channel 2E and a nozzle plate 15E by forming a groove 51E (recess) in an upper surface of a nozzle plate 15E so as to provide a non-joining portion 45E, and a projection 43E may be formed by supplying air or the like into the space 40E.

Sixth Modified Embodiment

Figure 13A:
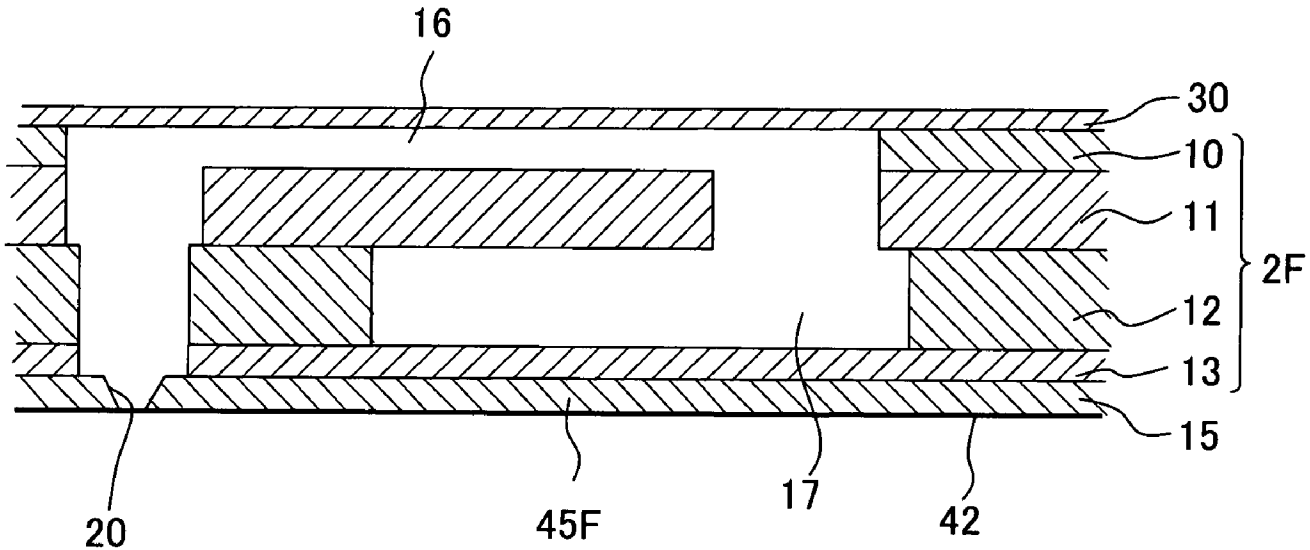
Figure 13B:
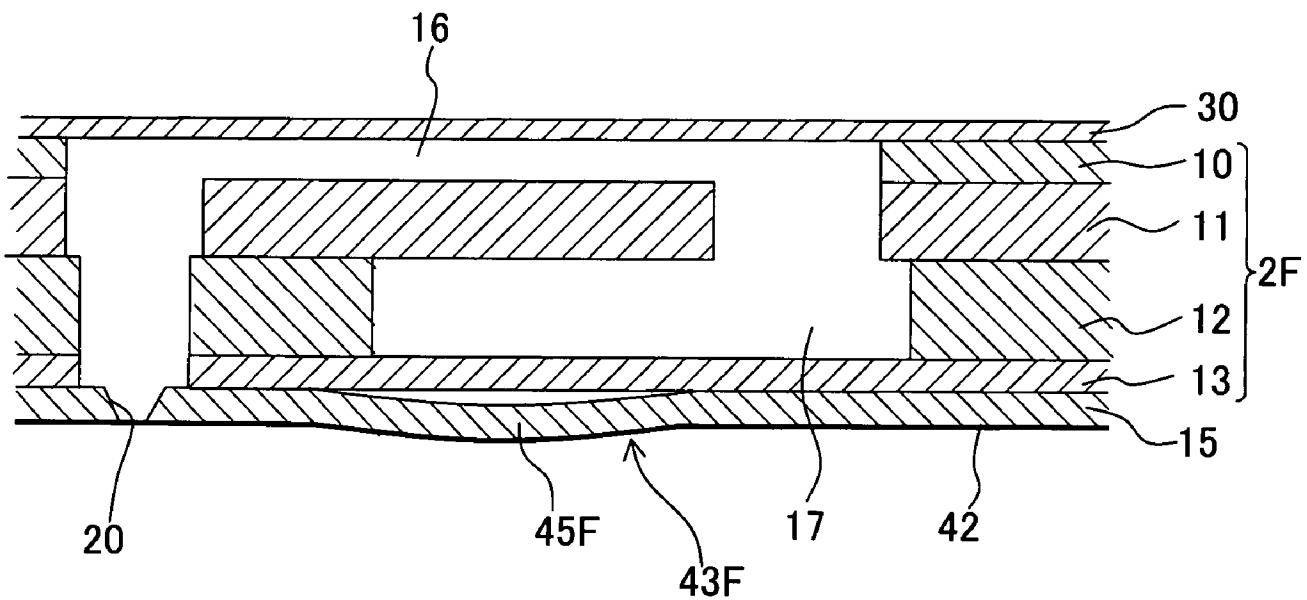

Still alternatively, without forming a recess in the channel unit or the nozzle plate, a projection can be formed on the nozzle plate by supplying a fluid such as air between the channel unit and the nozzle plate. Firstly, as shown in FIG. 13A, without forming a groove and a through hole in both of the nozzle plate 15 and the cover plate 13 which is the lowermost layer of a channel unit 2F, the nozzle plate 15 is joined to the channel unit 2F (cover plate 13). In this case, however, the cover plate 13 and the nozzle plate 15 are not joined at a portion (non-joining portion 45F), by not applying an adhesive on the lower surface of the cover plate 13 at a portion which is away to some extent from the area around the nozzles 20 in the scanning direction and the upper surface of the nozzle plate 15 at a portion which is away to some extent from the area around the nozzles 20 in the scanning direction. At this time, consequently, a gap equivalent to a thickness of the adhesive is formed between the cover plate 13 and the non-joining portion 45F of the nozzle plate 15. Therefore, as shown in FIG. 13B, it is possible to form a projection 43F by supplying, via the air supply port 29 and the communicating channel 28 as in the embodiment (see FIGS. 2 and 3), the pressurized air into the gap between the cover plate 13 and the non-joining portion 45F of the nozzle plate 15, so as to inflate the non-joining portion 45.

Seventh Modified Embodiment

Figure 14:
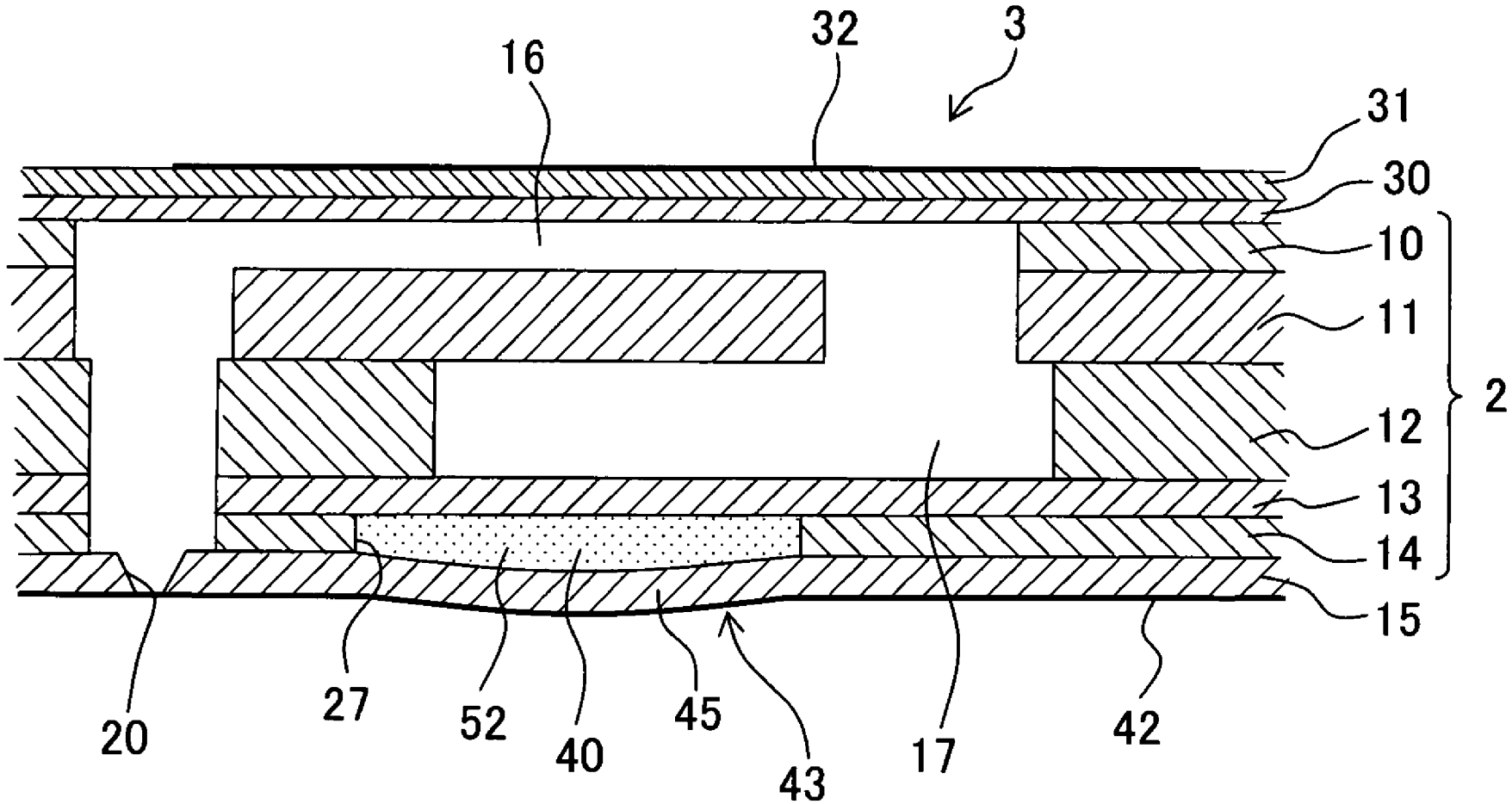
FIG. 14 is a cross-sectional view of a seventh modified embodiment, corresponding to FIG. 5.

The step of filling the filling material between the channel unit and the non-joining portion (projection) of the nozzle plate (filling step) may be performed after forming the projection in the nozzle plate. For example, as shown in FIG. 14, after forming the projection 43 by supplying the air into the space 40 under a reduced-pressure condition, a filling material 52 in the form of a liquid is filled into the space 40 from the air supply port 29 and the communicating channel 28 (see FIGS. 2 and 3), and then the filling material 52 is solidified. As the filling material 52, it is possible to use, for example, a thermosetting resin such as an epoxy resin. Alternatively, a pressurized fluid such as a pressurized liquid or air can be used as the filling material. In this case, the pressurized fluid can be filled in the step of forming the projection. Thus, when the filling material 52 is filled into the space between the channel unit 2 and the non-joining portion 45 (projection 43) of the nozzle plate 15, it is possible to suppress the deformation of the projection 43 due to being pressed by the wiper during wiping.

Eighth Modified Embodiment

Figure 15:
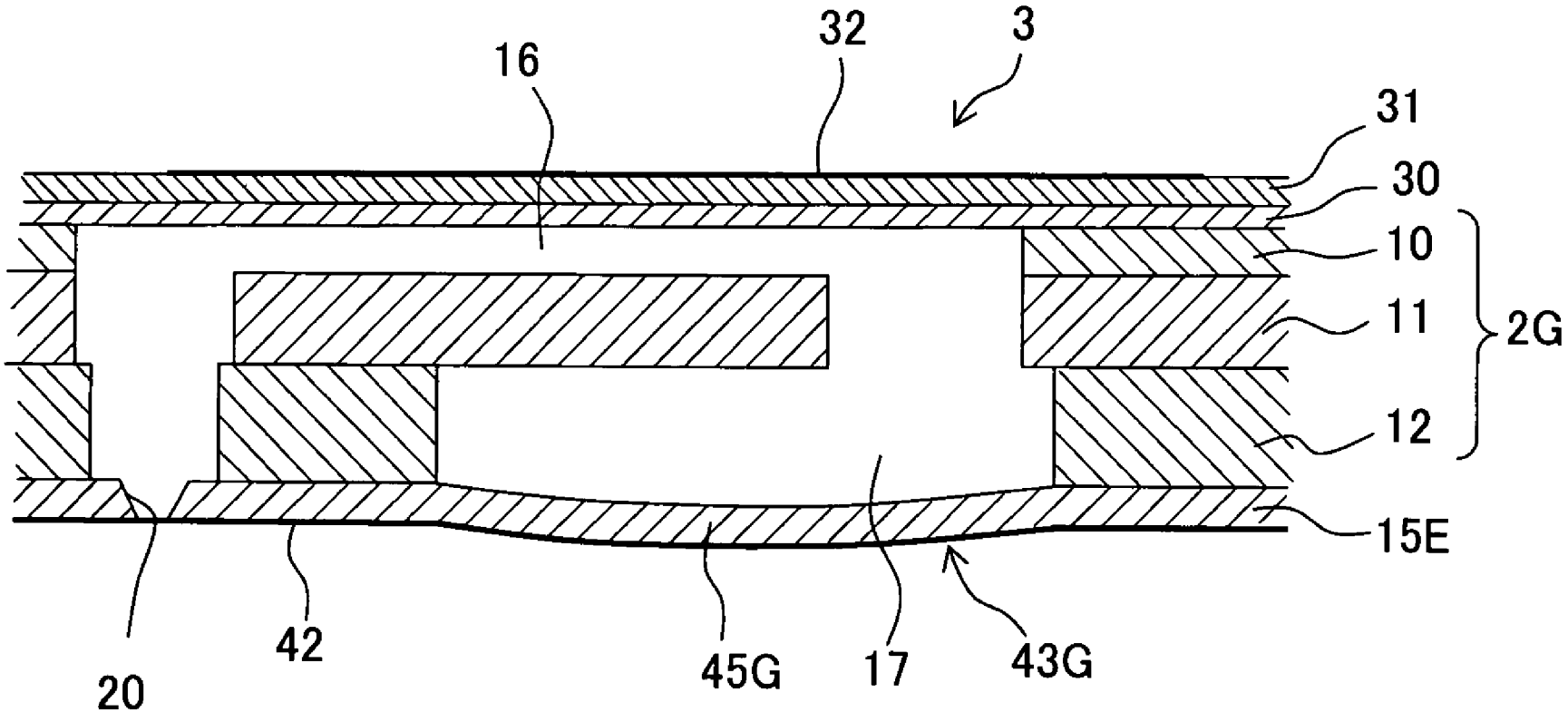
FIG. 15 is a cross-sectional view of an eighth modified embodiment, corresponding to FIG. 5.

In the above embodiment, between the nozzle plate 15 and the channel unit 2, the space 40 into which a fluid such as air is supplied is formed independently from the ink channel such as the manifold 17 in the channel unit 2 (see FIG. 5). However, the space into which the air is supplied may form a portion of the ink channel. For example, as shown in FIG. 15, when a structure is adopted such that the nozzle plate 15 is joined to the lower surface of the manifold plate 12 so as to cover the manifold 17, a projection 43G can be formed by supplying the air into the manifold 17 so as to downwardly inflate a non-joining portion 45G, of the nozzle plate 15, which is not joined to the manifold plate 12. In this structure, there is no need to form a space, into which the air is supplied, separately from the ink channel, and thus the producing process can be simplified. Further, it is also possible to reduce the number of plates constructing a channel unit 2G.

Ninth Modified Embodiment

Figure 16:
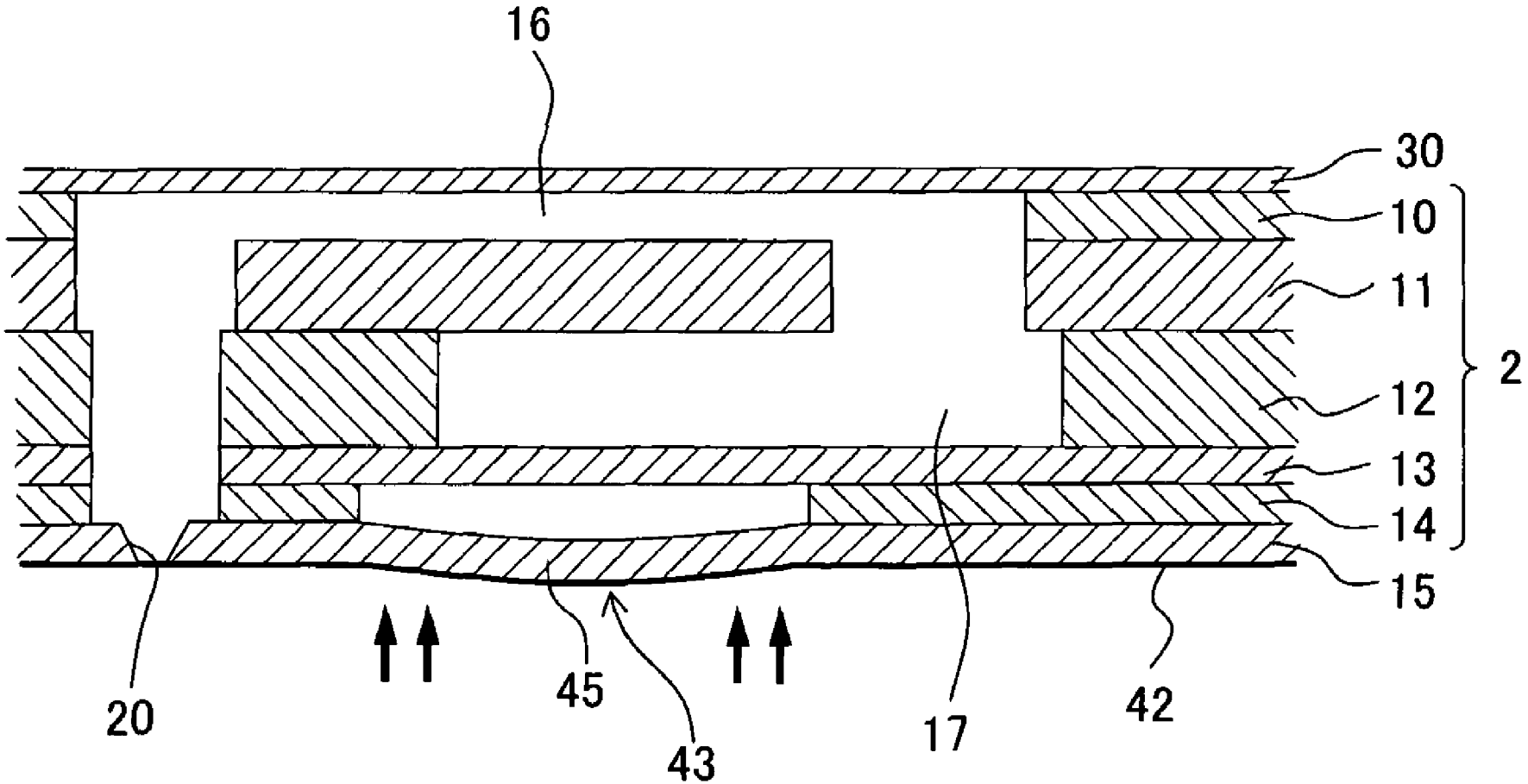
FIG. 16 is a diagram showing a projection forming step in a ninth modified embodiment.

The method for forming a projection by inflating the non-joining portion of the nozzle plate is not limited to the above-mentioned method of supplying a fluid such as pressurized air between the channel unit and the nozzle plate. For example, when the nozzle plate is made of a metallic material, it is possible to use a laser forming processing in which an object to be processed is shaped to have a desired shape by heating the object locally. In this case, as shown in FIG. 16, when two positions of the non-joining portion 45 of the nozzle plate 15 are heated locally by irradiating laser beams from below as shown by arrows in the drawing, a temperature gradient is developed at the heated positions in a direction of thickness of the plate, and due to a difference in an amount of thermal deformation caused by the temperature gradient, a bending deformation is occurred at the heated positions. At this time, a portion between the two heated positions is inflated downward (direction opposite to the channel unit 2), thereby forming the projection 43. Thus, when the nozzle plate 15 is made of a material having a high stiffness, such as metallic material, it is fairly difficult to form the projection 43 with the above method using the pressurized fluid. However, when the laser forming processing is used, the projection 43 can be formed easily.

The embodiment and its modified embodiments in which the present invention is applied to an ink-jet head have been explained. However, an embodiment to which the present invention is applicable is not limited to the embodiment and the modified embodiments described above. For example, the present invention can also be applied to an ink-jet printer having a line head, and to various liquid-droplet jetting apparatuses which jet a liquid droplet other than ink.

What is claimed is:

1. A liquid-droplet jetting apparatus comprising:

a channel unit which includes a plurality of plates and in which a liquid channel is formed; and a nozzle plate which includes a nozzle communicating with the liquid channel, and a liquid repellent film formed on a liquid jetting surface in which an ejecting port of the nozzle is arranged, the nozzle plate having a joining portion which is joined to the channel unit and a non-joining portion which is not joined to the channel unit, a projection higher than an area around the nozzle being formed on the liquid jetting surface in the non-joining portion of the nozzle plate, wherein a space into which a fluid, for forming the projection by curving the non-joining portion toward a side opposite to the channel unit, is to be supplied is formed between the non-joining portion of the nozzle plate and the channel unit.

2. The liquid-droplet jetting apparatus according to claim 1, wherein a surface of the projection is formed to be a continuously smooth curved surface.

3. The liquid-droplet jetting apparatus according to claim 1, wherein the space forms a portion of the liquid channel.

4. The liquid-droplet jetting apparatus according to claim 1, wherein the space is formed independently from the liquid channel; and the channel unit has a communicating channel which communicates the space and an outside of the channel unit.

5. The liquid-droplet jetting apparatus according to claim 1, wherein:

the nozzle is formed as a plurality of individual nozzles in the nozzle plate;

the liquid channel has a common liquid chamber which communicates with the individual nozzles;

the plurality of plates include a first plate and a second plate;

a plurality of holes which form the liquid channel are formed in each of the plurality of plates, and the plurality of plates are joined mutually in a stacked form;

the first plate formed with a space-forming hole which forms the space is joined to the nozzle plate; and the space and the common liquid chamber are partitioned by the second plate which is joined to a surface of the first plate on a side opposite to the nozzle plate.

6. The liquid-droplet jetting apparatus according to claim 1, wherein the nozzle plate is formed of a synthetic resin material.

7. The liquid-droplet jetting apparatus according to claim 1, wherein a thickness of the nozzle plate is partially decreased at the non-joining portion.

8. The liquid-droplet jetting apparatus according to claim 1, wherein the projection is arranged to surround an area in which the nozzle is formed.

9. The liquid-droplet jetting apparatus according to claim 1, wherein the nozzle is formed as a plurality of individual nozzles arranged in a row in the nozzle plate; and the projection is arranged parallel to a direction of the row of the individual nozzles.

10. A liquid-droplet jetting apparatus comprising:

a channel unit which includes a plurality of plates and in which a liquid channel is formed; and a nozzle plate which includes a nozzle communicating with the liquid channel, and a liquid repellent film formed on a liquid jetting surface in which an ejecting port of the nozzle is arranged, the nozzle plate having a joining portion which is joined to the channel unit and a non-joining portion which is not joined to the channel unit, a projection higher than an area around the nozzle being formed on the liquid jetting surface in the non-joining portion of the nozzle plate, wherein the nozzle is formed as a plurality of individual nozzles arranged in a row in the nozzle plate;

the projection is arranged parallel to a direction of the individual nozzles;

the channel unit and the nozzle plate are structured to be movable integrally in a direction orthogonal to the direction of the row of the individual nozzles; and the projection is arranged, in the nozzle plate, outside of an area in which the individual nozzles are formed, with respect to the direction orthogonal to the direction of the row.

11. A liquid-droplet jetting apparatus comprising:

a channel unit which includes a plurality of plates and in which a liquid channel is formed; and a nozzle plate which includes a nozzle communicating with the liquid channel, and a liquid repellent film formed on a liquid jetting surface in which an ejecting port of the nozzle is arranged, the nozzle plate having a joining portion which is joined to the channel unit and a non-joining portion which is not joined to the channel unit, a projection higher than an area around the nozzle being formed on the liquid jetting surface in the non-joining portion of the nozzle plate, wherein a filling material is filled between the non-joining portion of the nozzle plate and the channel unit.

12. A liquid-droplet jetting apparatus comprising:

a channel unit in which a liquid channel is formed; and a nozzle plate which includes a nozzle communicating with the liquid channel, and a liquid repellent film formed on a liquid jetting surface in which an ejecting port of the nozzle is arranged:

wherein a projection which is higher than an area around the nozzle is formed on the liquid jetting surface of the nozzle plate; and a space which is independent from the liquid channel is formed between the projection of the nozzle plate and the channel unit.

13. The liquid-droplet jetting apparatus according to claim 12, wherein a pressurized fluid is filled in the independent space.

14. A method of producing a liquid-droplet jetting apparatus including a channel unit in which a liquid channel is formed; and a nozzle plate which includes a nozzle communicating with the liquid channel, and a liquid repellent film which is formed on a liquid jetting surface in which an ejecting port of the nozzle is arranged, the method comprising:

a joining step of joining a surface of the nozzle plate on a side opposite to the liquid jetting surface, to the channel unit, at a joining portion of the nozzle plate;

a projection forming step of forming a projection by curving a non-joining portion of the nozzle plate, which is not joined to the channel unit, toward a side opposite to the channel unit as compared with an area around the nozzle; and a recess forming step of forming a recess in a portion of the nozzle plate facing the non-joining portion or a portion of the channel unit facing the non-joining portion, wherein the recess forming step is performed before the joining step;

in the joining step, the nozzle plate is joined to the channel unit, in a state in which a space is formed, by the recess, between the non-joining portion of the nozzle plate and the channel unit; and in the projection forming step, a fluid is supplied into the space, and the projection is formed by curving the non-joining portion toward the side opposite to the channel unit with the fluid.

15. The method of producing the liquid-droplet jetting apparatus according to claim 14, wherein the nozzle plate is formed of a synthetic resin material.

16. The method of producing the liquid-droplet jetting apparatus according to claim 14, wherein in the projection forming step, the projection is formed by curving the non-joining portion toward the side opposite to the channel unit, by locally heating the non-joining portion by a laser.

17. A method of producing a liquid-droplet jetting apparatus including a channel unit in which a liquid channel is formed, and a nozzle plate which includes a nozzle communicating with the liquid channel, and a liquid repellent film which is formed on a liquid jetting surface in which an ejecting port of the nozzle is arranged, the method comprising:

a joining step of joining a surface of the nozzle plate on a side opposite to the liquid jetting surface, to the channel unit, at a joining portion of the nozzle plate;

a projection forming step of forming a projection by curving a non-joining portion of the nozzle plate, which is not joined to the channel unit, toward a side opposite to the channel unit as compared with an area around the nozzle; and a filling step of filling a filling material between the non-joining portion of the nozzle plate and the channel unit, the filling step being performed after the projection forming step.

* * * * *

UNITED STATES PATENT AND TRADEMARK OFFICE

CERTIFICATE OF CORRECTION

PATENT NO. : 7,575,304 B2
APPLICATION NO. : 11/434936
DATED : August 18, 2009
INVENTOR(S) : Hiroto Sugahara It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 607 days.

Signed and Sealed this

Seventh Day of September, 2010

David J. Kappos

David J. Kappos
*Director of the United States Patent and Trademark Office*